United States Patent [19]

Crow et al.

[11] Patent Number: 4,921,048

[45] Date of Patent: May 1, 1990

[54] WELL PRODUCTION OPTIMIZING SYSTEM

[75] Inventors: Robert W. Crow, Irving; Ricky M. Holloman, Lewisville; James B. Pruden, Odessa, all of Tex.

[73] Assignee: Otis Engineering Corporation, Dallas, Tex.

[21] Appl. No.: 247,760

[22] Filed: Sep. 22, 1988

[51] Int. Cl.[5] ..... E21B 43/12

[52] U.S. Cl. ..... 166/372; 137/624.2; 166/53; 166/64; 166/66

[58] Field of Search ..... 166/372, 53, 64, 66; 137/624.2; 417/56–58

[56] References Cited

U.S. PATENT DOCUMENTS

| | | | |
|---|---|---|---|
| 4,150,721 | 4/1979 | Norwood | 166/53 |
| 4,267,885 | 5/1981 | Sanderford | 166/250 |
| 4,352,376 | 10/1982 | Norwood | 137/624.15 |
| 4,355,365 | 10/1982 | McCracken et al. | 364/569 |
| 4,526,228 | 7/1985 | Wynn | 166/53 |
| 4,633,954 | 1/1987 | Dixon et al. | 166/372 |
| 4,664,602 | 5/1987 | Gordon | 166/53 |
| 4,685,522 | 8/1987 | Dixon et al. | 166/372 |

OTHER PUBLICATIONS

"Differential Control System Operating Manual", dated Aug. 27, 1982 by Plunger Lift Systems, Inc.

*Primary Examiner*—Hoang C. Dang

*Attorney, Agent, or Firm*—Johnson & Gibbs

[57] ABSTRACT

A programmable system for controlling the operation of a plunger completion oil or gas production well to optimize production from the well. The controller operates one or more motor valves controlling the well in accordance with programmable values of off-time, on-time and exhaust-time. The controller monitors whether or not a plunger arrival signal is received on each cycle of intermitting the well and changes either the off-time on the exhaust-time for the next cycle in response thereto. In oil well mode, the off-time is decreased slightly for each cycle following a cycle in which plunger arrival occurred and increased slightly for each cycle following one in which it did not. In gas well mode, the exhaust-time is increased slightly for each cycle following a cycle in which plunger arrival occurred before on-time expired and decreased slightly for each cycle following one in which it did not.

39 Claims, 14 Drawing Sheets

WELL PRODUCTION OPTIMIZING SYSTEM

BACKGROUND OF THE INVENTION

1. Field of the Invention

The present invention relates to a system for electronically controlling a petroleum production well and, more particularly, a system for intermitting the operation of the well in order to optimize the production efficiency from the well.

2. History of the Prior Art

Each underground hydrocarbon producing formation, known as a reservoir, has its own characteristics with respect to permeability, porosity, pressure, temperature, hydrocarbon density and relative mixture of gas, oil and water within the formation. In addition, various subterranean formations comprising a reservoir are interconnected with one another in an individual and distinct fashion so that the production of hydrocarbon fluids at a certain rate from one area of one formation will affect the pressures and flows from a different area of an adjacent formation.

Certain general characteristics are, however, common to most oil and gas wells. For example, during the life of any producing well, the natural reservoir pressure decreases as gases and liquids are removed from the formation. As the natural downhole pressure of a well decreases, the well bore tends to fill up with liquids, such as oil and water, which block the flow of the formation gas into the borehole and reduce the output production from the well in the case of a gas well and comprise the production fluids themselves in the case of an oil well. In such Wells, it is also conventional to periodically remove the accumulated liquids by artificial lift techniques Which include plunger lift devices, gas lift devices and downhole pumps. In the case of oil wells within which the natural pressure is decreased to the point that oil does not spontaneously flow to the surface due to natural downhole pressures, fluid production may be maintained by artificial lift methods such as downhole pumps and by gas injection lift techniques. In addition, certain wells are frequently stimulated into increased production by secondary recovery techniques such as the injection of water and/or gas into the formation to maintain reservoir pressure and to cause a flow of fluids from the formation into the well bore.

In oil and gas wells wherein the ambient reservoir pressure has been substantially depleted, two general techniques are commonly used: (1) plunger lift and (2) gas lift. In oil wells the goal of these techniques is to bring quantities of production liquids to the surface for collection while in the case of gas wells the goal is to clear the liquids from the well to allow the free flow of production gas from the well.

Plunger lift production systems include the use of a small cylindrical plunger which travels through tubing extending from a location adjacent the producing formation down in the borehole to surface equipment located at the open end of the borehole. In general, fluids which collect in the borehole and inhibit the flow of fluids out of the formation and into the well bore, are collected in the tubing. Periodically the end of the tubing is opened at the surface and the accumulated reservoir pressure is sufficient to force the plunger up the tubing. The plunger carries with it to the surface a load of accumulated fluids which are ejected out the top of the well. In the case of an oil well, the ejected fluids are collected as the production flow of the well, and in the case of a gas well the ejected fluids are simply disposed of thereby allowing gas to flow more freely from the formation into the well bore and be delivered into a gas distribution system at the surface. In the case of a plunger completion gas well, the production system is operated so that after the flow of gas from the well has again become restricted due to the further accumulation of fluids downhole, a valve in the tubing at the surface of the well is closed so that the plunger falls back down the tubing and is ready to lift another load of fluids to the surface upon the reopening of the valve. In the case of a plunger completion oil well, as soon as the plunger has reached the surface a valve in the tubing at the wellhead is closed so that the plunger also falls back down the tubing and is ready to lift another load of production fluids to the surface upon the accumulation of sufficient downhole casing pressure to lift the plunger and its load and the subsequent reopening of the valve.

A gas lift production system includes a valve system for controlling the injection of pressurized gas from a source external to the well, such as another gas well or a compressor, into the borehole. The increased pressure from the injected gas forces accumulated formation fluids up a central tubing extending along the borehole to remove the fluids as production flow or to clear the fluids and restore the free flow of gas and/or oil from the formation into the well. In wells where liquid fallback is a problem during gas lift, plunger lift may be combined with gas lift to improve efficiency. Such a system is shown in U.S. Pat. No. 4,211,279 issued July 8, 1980 to Kenneth M. Isaaks.

In each of the above cases, there is a requirement for the periodic operation of a motor valve at the surface of the wellhead to control either the flow of liquids and/or gas from the well or the flow of injection gas into the well to assist in the production of gas and liquids from the well. These motor valves are conventionally controlled by timing mechanisms and are programmed in accordance with principles of reservoir engineering which attempt to determine the length of time that a well should either be "shut in" and restricted from flowing gas or liquid to the surface and the length of time that the well should be "opened" to freely produce. Historically, the main criterion which has been used for the operation of the motor valve is strictly one of the elapse of a preselected time period. In some cases, measured well parameters, such as pressure, temperature, etc. are used to override the timing cycle under special conditions.

For example, U.S. Pat. No. 4,354,524 discloses a pneumatic timing system which improves the efficiency of using injected gas to artificially lift liquids to the wellhead by means of the plunger lift technique. U.S. Pat. No. 3,336,945 to Bostock et al. discloses a pneumatic timing device for use in timing the intermittent operation and/or injection of wells to increase the production. U.S. Pat. No. 4,355,365 to McCracken et al. discloses a system for electronically intermitting the operation of a well in accordance with timing techniques.

Other systems, such as the differential control system manufactured by Plunger Lift Systems, Inc. of Marietta, Ohio serve to operate a plunger lift completion in accordance with a gating system in which measured values of pressure and fluid level are compared with pre-set values. U.S. Pat. No. 4,150,721 to Norwood discloses a similar gas well controller system which also utilizes digital logic circuitry gating to operate a well in response to a timing counter and certain measured well parameters. U.S. Pat. No. 4,685,522 to Dixon et al. discloses a micro-processor based well production controller system Which monitors external parameters of the well and calculates values based upon an algorithm used to describe the performance of the well in order to control production from the well.

Under most circumstances, however, the mere timed intermittent operation of a single motor valve to control either outflow from the well or gas injection to the well will not effect maximum production nor will operation of the well based upon the comparison of well parameters with pre-set maximum and minimum values. This is primarily because the performance characteristics of the well are affected by a number of factors which continue to change over time. For example, the formation itself changes as production is taken from it so that the rate at which casing pressure builds up within the well to a value which is sufficient to cause the plunger to reach the surface also continues to change. Similarly, changes in the pressure of the output line from the well caused by a compressor or a production processing facility downstream, also cause pressure perturbations in the tubing of the well and affect the rate at which the plunger will rise to the surface of the tubing.

Other, more sophisticated, approaches to well production optimization have been used. For example, certain parameters associated with the producing well, such as casing pressure, tubing pressure, flow rate and pressure and oil/water mix, have been used as criteria upon which to base a decision as to when to intermittently open or close a well or when to intermittently inject fluids into the well to stimulate production of gas and/or liquids therefrom. These techniques have also encountered certain difficulties in that the changing parameters of the well cause the algorithms used to make the control decisions concerning intermitting of the well to become incorrect and no longer reflective of the well's performance.

An essential concept which must be taken into consideration when attempting the efficient intermitting of production flow from a well is that the characteristics of the well itself are extremely changeable things. A well is continually varying in its performance characteristics based upon both external and internal parameters so that it is virtually impossible to either program fixed time periods, as in the case with simple timed intermitter controllers, or to program in algorithms or parameter measurement based controls and have the well operate for a reasonable period of time without something in the well changing and altering the theory underlying the programming being used to attempt optimizing production from the well. In addition, the field within which the well is located also changes. Frequently production operations at other wells in the same reservoir or repair work on a separator within the gathering system to which the well is connected can cause a well to begin to load up and the preselected time periods of a timed intermitter will no longer be effective to optimize the controlled flow from the well.

A major factor to be considered in well operation is that throughout the intermitting of a well, the operator should guard against having the well "load up". This is a condition in which so much fluid is accumulated in the well bore that the maximum casing pressure of which the well is capable is insufficient to raise the plunger to the surface and purge the well of the accumulated fluids. Once a well loads up, it must be specially treated to remove the fluids from within the well and allow the intermitting process to begin again. Thus, if the well is not periodically "shut in" for a long enough period of time to allow sufficient downhole casing pressure to accumulate in order to raise the plunger all the way to the surface and completely clear the well when the valve at the wellhead is opened, it will require even greater casing pressure to do so the next time the valve is opened. The value of the accumulated downhole casing pressure is generally a direct function of the length of time during which the well is "shut in" before the surface valve is opened again.

When a well is manually intermitted, a well operator physically visits each well site on a periodic basis and either shuts the well in for a pre-selected period of time or opens the valve at the surface and allows the well to flow for a preselected period of time. In the mechanical timer operated intermitters, a mechanical device replaces the manual opening and closing of the valve by a timed opening and closing thereof. The operator simply selects the time period during which the well is to be shut in and the time period during which the well is to be allowed to flow and the intermitter automatically operates the valve. Experience over many years has shown that with both manual operation and timer controlled intermitters, operators generally select time periods which are relatively conservative with respect to optimizing the production flow from the well but which guard against the possibility of the well "loading up" and necessitating an expensive cleaning in order to place the well back into production again. In addition, operators tend to be distrustful of sophisticated electronic well optimizing equipment because they know from their experience even though there may be certain monitored parameters upon which intermitting of the well is based, the performance parameters of the well frequently change and thereby eliminate the accuracy with which the well is being operated. These inaccuracies introduce a risk of loading the well and the resultant negative reflection on the job performance by the operator which that brings.

A conservative approach to the intermitting of a well results in substantial waste of potential production capacity of the well. That is, in the case of a plunger completion oil well, the production flow from the well is directly related to the number of trips which the plunger makes from the bottom of the well to the wellhead in a given time period. Each time the plunger cycles and makes a round trip from the bottom, it delivers a slug of fluid as the production output from the well. Thus, it is desirable to allow the plunger to remain at the bottom only long enough to have the bottom hole pressure build to a value sufficient to raise the plunger all the way to the surface and complete a full cycle. Attempting to cycle the well too quickly results in the bottom hole pressure not building to a value large enough to raise the plunger all the way to the surface and its stopping its travel at some intermediate point and being unable to go further. This condition then requires the well to be again shut in. Failure of the bottom hole pressure to build to a sufficient value to clear the well the second time it is opened for flow runs the risk of loading the well and the required time and expense of swabbing the well before it can be again placed in production.

In the case of a plunger completion gas well, the quantity of production gas from the well is directly related to the length of time that the well can be left in an open and flowing condition without closing it in to cycle the plunger and clear accumulated fluids from the well to allow the free flow of gas from the well. Attempting to not leave the well closed for a sufficiently long period to build sufficient bottom hole pressure to raise the plunger all the way to the surface and fully clear the well of fluid again risks loading of the well and the cessation of production from the well until it has been cleared.

Because of the changing conditions within the well, in the reservoir within which the well is located, and in the external equipment connected to the output from the well, the rate at which the bottom hole pressure builds toward a value which is sufficient to cycle the plunger continues to vary throughout the life of the well. A controller which constantly evaluates the success with which the plunger is being repeatedly cycled and attempts to reduce the off-time while still successfully cycling the plunger would tend toward optimizing production from the well.

Moreover, it would be highly desirable to provide a programmable controller for the operation of a motor valve connected to a plunger completion well whereby the controller continues to reduce by small increments on each cycle the time that the well is shut in on each cycle in order to maximize the number of trips that the plunger is capable of making, for an oil well, or to maximize the gas flow time period for a gas well, both given the particular operating conditions of the well at any given time. Further, the controller should recognize when the off time for the well has been reduced to a value insufficient to fully cycle the plunger and compensate by increasing the off time during the next cycle by an incremental value sufficient to ensure the completion of the cycle. The system of the present invention provides such a programmable controller and method of well control for the optimization of well production while guarding against loading of the well.

The system of the present invention can be used in multiple applications for producing wells, for example, in any well which includes a cycling plunger such as gas lift completions, plunger lift completions, wells having fluctuating bottom hole pressures and production flow rates and, in addition, for the unloading or gas wells.

SUMMARY OF THE INVENTION

An object of the present invention is to provide an electronic controller which detects the arrival of a cycling plunger at the wellhead and monitors the time required for the plunger to make each particular round trip to the surface. The controller periodically changes the time during which the well is shut in, in order to maximize the production from the well.

Another object of the present invention is to provide a system which includes a motor valve and a programmable electronic controller Which continually adjusts the time periods for the opening and closing of the motor valve for optimum formation fluid production. In addition, another object includes providing a system which monitors the arrival of a plunger at the wellhead in order to ensure that the well was shut in long enough for the plunger to make a round trip and thereafter decreases the off time of the well by a pre-selected value to attempt to again cycle the well but with a slightly shorter off time period.

A still further object of the present invention is to provide a system which monitors the arrival of a plunger at the well surface and attempts to increase the length of gas flow time from the well during each cycle by a pre-selected value while ensuring that the plunger arrives on each cycle. The invention thereby attempts to allow the well to flow for a slightly longer period during each cycle than during the previous cycle in order to maximize the production of gas from the well.

A further object of the present invention is to provide an electronic controller for an oil/gas production system which is fully programmable and has a display panel which allows periodic re-programming thereof based upon selected parameters.

In one aspect the invention includes a method and system for optimizing the production from a petroleum producing well having a motor valve connected between the tubing of the well and a flow sales line and a plunger mounted for movement within the tubing of the well from the bottom thereof to the well head to carry liquids from the well to the flow sales line in response to downhole casing pressure when the motor valve is open. The well is intermitted by opening and closing the motor valve in accordance with an off-time, an on-time and a plunger arrival signal. The off-time is decreased by a pre-selected incremental value each time a plunger arrival signal is produced prior to the expiration of the on-time and the off-time is increased by a preselected incremental value each time the on-time expires prior to production of a plunger arrival signal. In addition, the off-time is increased by a second pre-selected value greater than the pre-selected value, in response to expiration of the on-time prior to production of a plunger arrival signal on two successive cycles of intermitting.

In another aspect the invention includes a method and system for controlling the cyclic operation of a petroleum producing well having a motor valve connected between the tubing of the well and a flow sales line. A plunger is mounted for reciprocating movement within the tubing of the well from the bottom thereof to the well head to carry production liquids from the well to the flow sales line in response to downhole casing pressure when the motor valve is open. Arrival of the plunger at its uppermost position in the well tubing is sensed and the motor valve is closed in response thereto. A selectively programmable memory stores signals indicative of a first time period during which the motor valve is to be closed and the well is to be shut in and second time period during which the motor valve is to be open and the fluid in the tubing allowed to flow into the sales line. The motor valve is closed and the first time period is begun. Thereafter, the motor valve is opened in response to expiration of the first time period and the second time period is begun. Next, the motor valve is closed and the first time period is begun in response to sensing plunger arrival. The first time period is decreased by a first selected incremental time value in response to the arrival of the plunger prior to expiration of the second time period. Similarly, the motor valve is closed and the first time period begun in response to expiration of the second time period while the first time period is increased by a second selected incremental time value in response to the failure of the plunger to arrive prior to the expiration of the second time period.

BRIEF DESCRIPTION OF THE DRAWING

For further understanding of the present invention and for further objects and advantages thereof, reference may now be had to the following description taken in conjunction with the accompanying drawing, in which.

DESCRIPTION OF THE PREFERRED EMBODIMENT

Plunger Lift Completion

Figure 1:
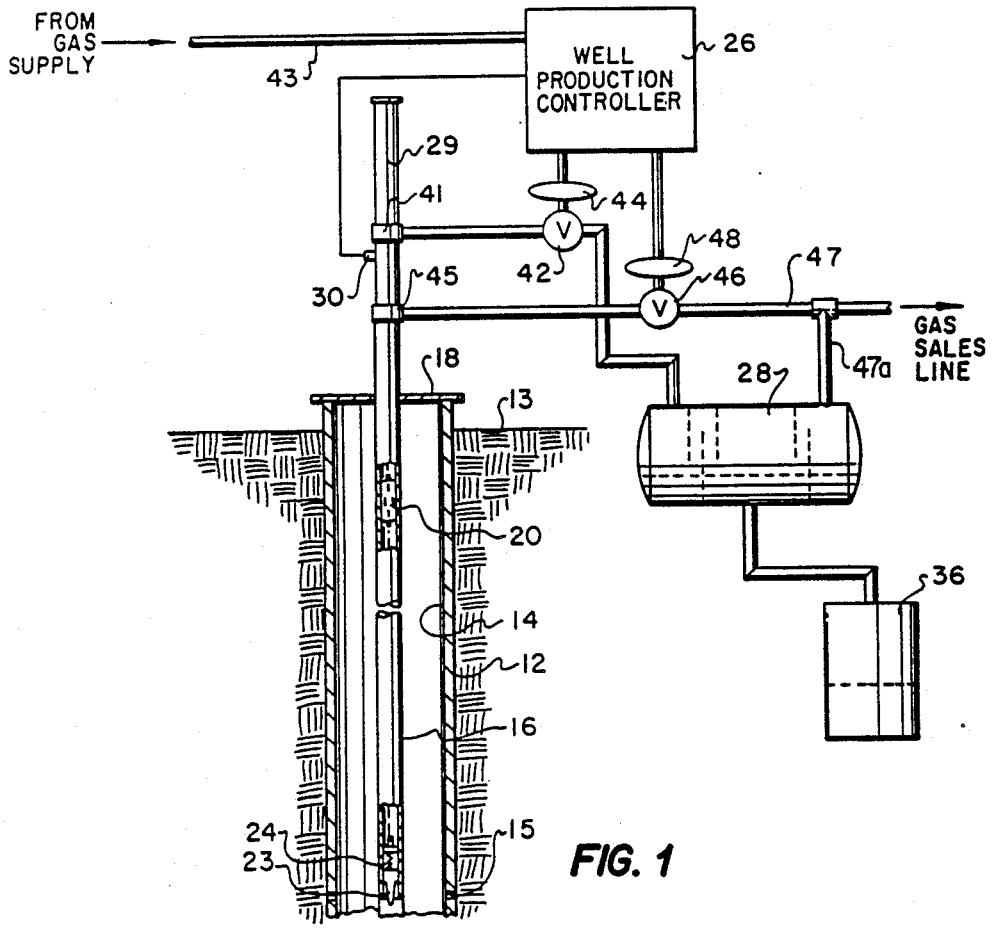
FIG. 1 is a schematic drawing of a plunger lift well completion having a pair of motor valves and including a programmable electronic controller constructed in accordance with the teachings of the present invention.

Referring first to FIG. 1, there is shown an illustrative schematic of a plunger lift completion well. The well includes a borehole 12 extending from the surface of the earth 13 down to the producing geological strata which is lined with a tubular casing 14. The casing 14 includes perforations 15 in the region of the producing strata to permit the flow of oil and/or gas from the formation into the casing 14 lining the borehole 12. The producing strata into which the borehole and the casing extend is formed of coarse rock and serves as a pressurized reservoir containing a mixture of gas, oil and water. The casing 14 is preferably perforated along the region of the borehole containing the producing strata in area 15 in order to allow fluid communication between the strata and the well. A string of tubing 16 extends axially down the casing 14.

Both the tubing 16 and the casing 14 extend into the borehole 12 from a wellhead 18 located at the surface above the well and which provide support for the string of tubing extending into the casing and closes the open end of the casing. The string of tubing 16 extends axially down the casing and is terminated by a tubing stop 23 and bumper spring 24. A reciprocating plunger 20 is positioned within the tubing 16 and is prevented from passing out the lower end of the tubing by the bumper spring 24 and tubing stop 23. The upper end of the tubing 16 is enclosed by a lubricator 29 which receives the plunger 20 when it is in its uppermost position. The lubricator 29 also includes a sensor 30 which detects the moment when the plunger has arrived at its uppermost position.

The upper end of the tubing 16 is connected to a first flow "T" 41 and a first motor valve 42 into a low pressure fluid delivery line leading to a separator 28. The first motor valve 42 is actuated by a pair of "on" and "off" solenoids 44 under control of a well production controller 26 constructed in accordance with the teachings of the present invention. The solenoids control the flow of pressurized air or gas supplied via line 43 by means not shown. The upper end of the tubing 16 is also connected to a second flow "T" 45 through a second motor valve 46 to a high pressure gas sales line 47. The second motor valve 46 is actuated by "on" and "off" solenoids 48 under control of controller 26.

It should also be understood that although the implementation of the invention shown in FIG. 1 includes two flow "T"s 41 and 45 and two motor valves 42 and 46, the system may also be operated with a single flow "T" and a single motor valve. For example, the first flow "T" 41 and first motor valve 42 could be the only ones present and used to provide an outlet from the well for both liquids as well as production gas. Moreover, in the following description of the operation of certain embodiments of the present controller only the flow "T" 41 and the motor valve 42 will be employed.

Oil Well Mode

In operation, the plunger lift completion of FIG. 1 is "closed in" for a pre-selected time period during which sufficient formation gas pressure is developed within the casing 14 to move the plunger 20, along with the fluids accumulated within the casing 14, to the surface as soon as the motor valve 42 in the tubing 16 is opened. This time period is known as "off time".

After passage of the selected "off time" period, the cycle is begun by opening the motor valve 42. As the plunger 20 rises to the surface in response to the accumulated downhole casing pressure, the accumulated fluids, oils and/or water carried by the plunger 20 pass out through the flow "T" 41, through the low pressure fluid line and into the separator 28. In the case where the completion shown in FIG. 1 is an oil well, the fluid which is carried to the surface by the plunger 20 is the production flow from the well. When the plunger arrival sensor 30 detects that the plunger 20 has reached the surface and is positioned in the lubricator 29, it provides a signal to the controller 26 which closes the motor valve 42 and ends the cycle. Thereafter, the plunger 20 will again fall down the tubing 16 to the bumper spring 24 and prepare for another round trip cycle.

The well must now remain "shut in" for a sufficient period of time to allow the pressure within the casing at the bottom of the borehole to increase to at least a certain minimum value. This is so that when the motor valve 42 is again reopened, there will be sufficient pressure differential between the downhole casing pressure and the pressure within the separator 28 at the surface to cause the plunger 30 to rise all the way to the surface and bring with it another slug of liquid as production fluids from the well. In the event that the well production controller 26 does not, within a pre-selected "on-time" period, detect a signal from the plunger arrival sensor 30 indicating that the plunger has reached the surface and is positioned in the lubricator 29, the controller recognizes that the downhole casing pressure was insufficient to raise the plunger all the way to the surface and complete a round-trip. After expiration of the selected "on time" period, the controller 26 again closes the motor valve 42 and begins another off-time period for the well of a slightly greater duration than the previous off-time to ensure that the plunger will cycle and reach the surface the next time the motor valve 42 is opened. This operation of the controller will be explained in greater detail below.

In the event that the well production controller 26 receives a signal from the plunger arrival sensor 30 indicating that the plunger 20 has reached the surface, delivered its load of fluid and is position in the lubricator 29, it again closes the motor valve 42 to allow the plunger 20 to return to the bottom of the tubing 16. The controller 26 then begins to time the off-time cycle of the well but since the well completely cycled during the last time the motor valve 42 was opened, the controller 26 changes the length of the off-time period of the well to decrease it by a pre-selected incremental value. In this way, the controller 26 attempts to cause the plunger 20 to again complete a round-trip cycle but in response to a downhole pressure which is allowed to build during a slightly shorter off-time than during the previous cycle. Decreasing the off-time period of the well results in a fractional increase in the number of roundtrips which the plunger can make during a given time period. The controller 26 continues to decrease the off-time by an incremented value each time the well successfully cycles until, eventually, the plunger 20 does not quite reach the plunger arrival sensor 30 and its fully up position in the lubricator 26. In this way, the controller 26 determines the absolute minimum value off-time period which will result in the plunger making a complete round-trip for the particular well conditions existent at that particular point in time.

Each time the controller 26 decreases the length of the off-time period following a complete cycle by the plunger, the length of the period is only decreased by a very small value, e.g. 5%. Thus, when the plunger does not quite reach the plunger arrival detector sensor 30 within the selected time-out period it can be assured that it almost reached the detector and, thus, unloaded essentially all of the liquid which it was bringing to the surface on that particular cycle.

When the well production controller 26 detects that the plunger 20 was not driven by a sufficient large value of downhole casing pressure to cause it to completely reach the plunger arrival sensor 30, it then increases the off-time period for the next cycle by a pre-selected value to ensure that during the next succeeding cycle the plunger will be sure to make a complete round-trip. In the event that the controller 26 detects two successive cycles during which the plunger fails to reach the sensor 30 during the time-out period, it greatly increases the off-time period for the next cycle to ensure that the plunger will reach the surface on the very next cycle. This reduces the possibility of loading the well during the process of fine tuning the system for the minimum off-time necessary to cycle the plunger. The detailed operation of the controller in performing these functions will be more fully described below.

Gas Well Mode

It should be understood that the well completion of FIG. 1 can be operated as a single motor valve completion gas well as described just above as an oil Well. In which case flow "T" 41 and motor valve 42 would be the only ones present and production gas would flow to the gas sales line through riser 47*a* after fluid had been delivered to the separator 28 as described below.

In the case that the plunger lift well completion of FIG. 1 is either a one or two motor valve completion gas well, the well is closed in for a selected "off-time" period just as in the case of oil well mode operation. After the expiration of the off-time of the two motor valve gas well of FIG. 1, the first motor valve 42 is opened to start the plunger 20 up the tubing 16. When the plunger arrival sensor 30 detects that the plunger 20 is positioned in the lubricator 29, and the slug of liquid carried by the plunger 20 has been delivered to the separator 28, the controller 26 closes the first motor valve 42 and simultaneously opens the second motor valve 46 to allow the high pressure formation gases to pass through the second flow "T" 45 and out the high pressure gas sales line 47. After a preselected time period of high pressure production gas flow through the line 47, referred to as "exhaust-time," the second motor valve 46 is again closed to shut in the well and allow the plunger 20 to drop back down the tubing 16 and the formation gas pressure to reaccumulate in the casing for a subsequent cycle. The controller 26 detects whether the plunger 20 was driven by sufficiently large value of downhole casing pressure when the motor valve was opened in order to reach its fully up position in the lubricator 29 and produce a plunger arrival sensor signal before a pre-selected "on-time" period on each successive cycle. If so, the controller 26 increases the length of the exhaust time period during Which the second motor valve 46 is allowed to remain open for the next succeeding cycle. The controller thereby attempts to extend the exhaust time period during which production gas is allowed to flow from the well on each successive cycle. The length of the production flow exhaust time is increased only slightly, e.g. 5%, on each succeeding cycle to attempt to maximize the production flow from the well. If following an on-time period, the controller 26 detects that the plunger arrival sensor 30 has not detected arrival of the plunger 20 to its position in the lubricator 29 within the pre-selected on time period, it recognizes that the downhole casing pressure did not reach a large enough value during the off-time period to fully cycle the plunger when the motor valve was opened. The controller 26 then skips the exhaust time period which would normally follow the on time and re-enters the off time period. The controller also modifies the time periods so that the next succeeding cycle, the exhaust-time period is decreased slightly in length to ensure that the bottom hole pressure is allowed to build to a sufficiently large value to fully cycle the plunger the next time the motor valve is opened following the selected value of off-time. In the event that the controller 26 encounters two successive off-time periods following which the plunger 20 does not reach the plunger arrival sensor 30 during the time out period, the length of exhaust-time is decreased by a significant value to ensure that on the very next cycle, the plunger will reach the sensor 30. In this manner, the controller eliminates the possibility of loading the well due to accumulation of a quantity of fluid in excess of that which the maximum bottom hole pressure will allow the plunger to lift.

In the description of gas well mode operation it has been assumed that a single, fixed value of off time has been chosen against which the exhaust time of the well is optimized. It should be understood, however, that the off-time could also be modified by the controller (as in the case of oil well mode), along with exhaust time, to select pairs of time values to optimize the production of gas from the well being controlled.

Gas Lift Completion

Figure 2:
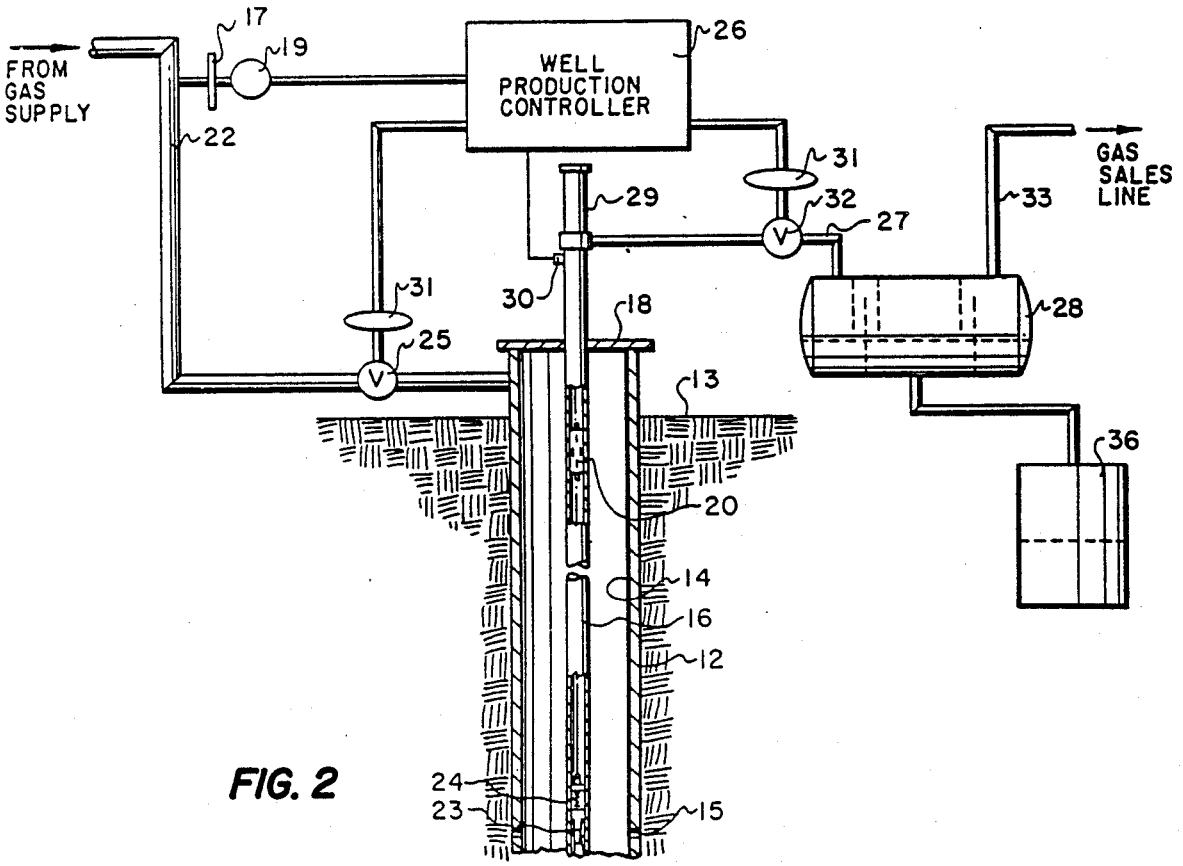
FIG. 2 is a schematic drawing of a gas injection plunger lift well completion having a pair of motor valves and including a programmable electronic controller constructed in accordance with the teachings of the present invention.

Referring next to FIG. 2, there is shown an illustrative schematic of a well equipped with a plunger lift completion with supplementary gas injection. The well includes a borehole 12 extending from the surface of the earth which is lined with a tubular casing 14 and which extends from the surface down to the producing geological strata. The casing 14 includes perforations 15 in the region of the producing strata to permit the flow of gas and/or oil from the formation into the casing lining the borehole. The casing 14 is preferably perforated along the region of the borehole containing the production strata in area 15 in order to allow fluid communication between the strata and the well. A string of tubing 16 extends axially down the casing 14.

Both the tubing 16 and the casing 14 extend into the borehole from a wellhead 18 located at the surface above the well which provides support for the string of tubing extending into the casing and closes the open end of the casing 14. The casing 14 is connected to a line 22 which supplies high pressure gas from an external source such as a compressor (not shown) through a first motor valve 25 into the casing 14. The first motor valve 25 is operated between the open and closed conditions by a programmable well production intermitter/controller 26 constructed in accordance with the teachings of the present invention. The tubing 16 is connected to a production flow line 27, through a second motor valve 32 and to a separator 28. The output flow from the tubing 16 into the production flow line 27 is generally a mixture of both liquids, such as oil, water, condensates, and gases and is directed through the separator 28 which effects the physical separation of the liquids from the gases and passes the gas into a sales line 33 for delivery to a gas gathering system. The liquids output from the separator 28 are directed into a liquid storage reservoir 36 for subsequent collection and/or disposal by known methods. Pressurized gas is also supplied through a filter 17 and a regulator 19 for use in pneumatically operating the motor valves 25 and 32 by means of solenoids 31.

The string of tubing 16 extends axially down the casing and is terminated by a tubing stop 23 and a bumper spring 24. A reciprocating plunger 20 is positioned within the tubing 16 and is prevented from passing out the lower end of the tubing by the bumper spring 24 and tubing stop 23. A packer (not shown) is located between the tubing and casing near the lower end of the tubing to close the casing and allow pressure to be built up from the injection of gas into the well. The upper end of the tubing 16 is closed by a lubricator 29 which receives the plunger 20 when it is in its uppermost position. The lubricator 29 also includes a sensor 30 which detects when the plunger 20 has arrived at its uppermost position and produces an output signal to the controller 26 indicating the arrival.

In a gas inject system of the type shown in FIG. 2, it is desirable to conserve gas and inject only as much gas through the first motor valve 25 as is required to move the plunger 20 up the tubing 16 and eject the accumulated fluids from the well through the second motor valve 32. In the event that the gas lift completion of FIG. 2 is an oil well, the controller operates so that once the plunger 20 has lifted the fluids to the surface, the first motor valve 25 is again closed to allow the plunger to return to the bottom of the tubing 16 for making another trip to the surface and deliver production fluids therewith.

In the case where the production completion of FIG. 2 is an oil well, as soon as the plunger 20 has reached the surface of the tubing 16 to eject the accumulated fluids from the well through the second motor valve 32, the first valve is closed and the second valve allowed to remain open for a pre-selected time period of production flow from the cleared well. When the well has been closed for a sufficient period of time to develop a formation pressure, liquids will have accumulated within the casing 14, in the region of the perforations 15 adjacent the producing formation. These formation fluids restrict the flow of gases from the formation into the casing so they are removed at the beginning of a production cycle when both the first and second motor valves 25 and 32 are opened simultaneously. The first motor valve 25 is opened by means of "on" solenoid 31 to inject a flow of high pressure gas from the external source into the casing 16 and raise the pressure therein. The second motor valve 32 is opened also by means of a "on" solenoid 31 to open the upper end of the tubing production flow line 27 and cause the plunger 20 to move upwardly within the tubing and bring along with it the quantity of formation fluids which have accumulated within the casing in the region of the producing formation. Liquids brought to the surface by the plunger 20 flow out through the second motor valve 32 and the production flow line 27 into the separator 28 in a conventional fashion. The plunger arrival sensor 30 detects when the plunger 20 has reached the top of the tubing and is positioned in the lubricator 29 and produces a plunger arrival output signal to the controller 26. In response to the plunger arrival signal, or in response to the passage of a pre-selected time-out period in the event the plunger does not arrive, whichever happens first, the controller 26 operates the "off" solenoid 31 of the first motor valve 25 to close the valve and stop gas injection. The second motor valve 32 is allowed to remain open for a pre-programmed time period to permit the flow of production gas from the formation. After the set time period, the second motor valve 32 is closed to permit the plunger 20 to fall back down the tubing string 16 and reposition itself at the bumper spring 24 for a subsequent trip to the surface to again empty the accumulated production fluids from the well.

The controller 26 can be operated to optimize both the production from the well as well as the utilization of input gas used to stimulate and control production from the well. This is done in the same way production is optimized in the plunger lift completion described above in connection with FIG. 1.

Figure 3:
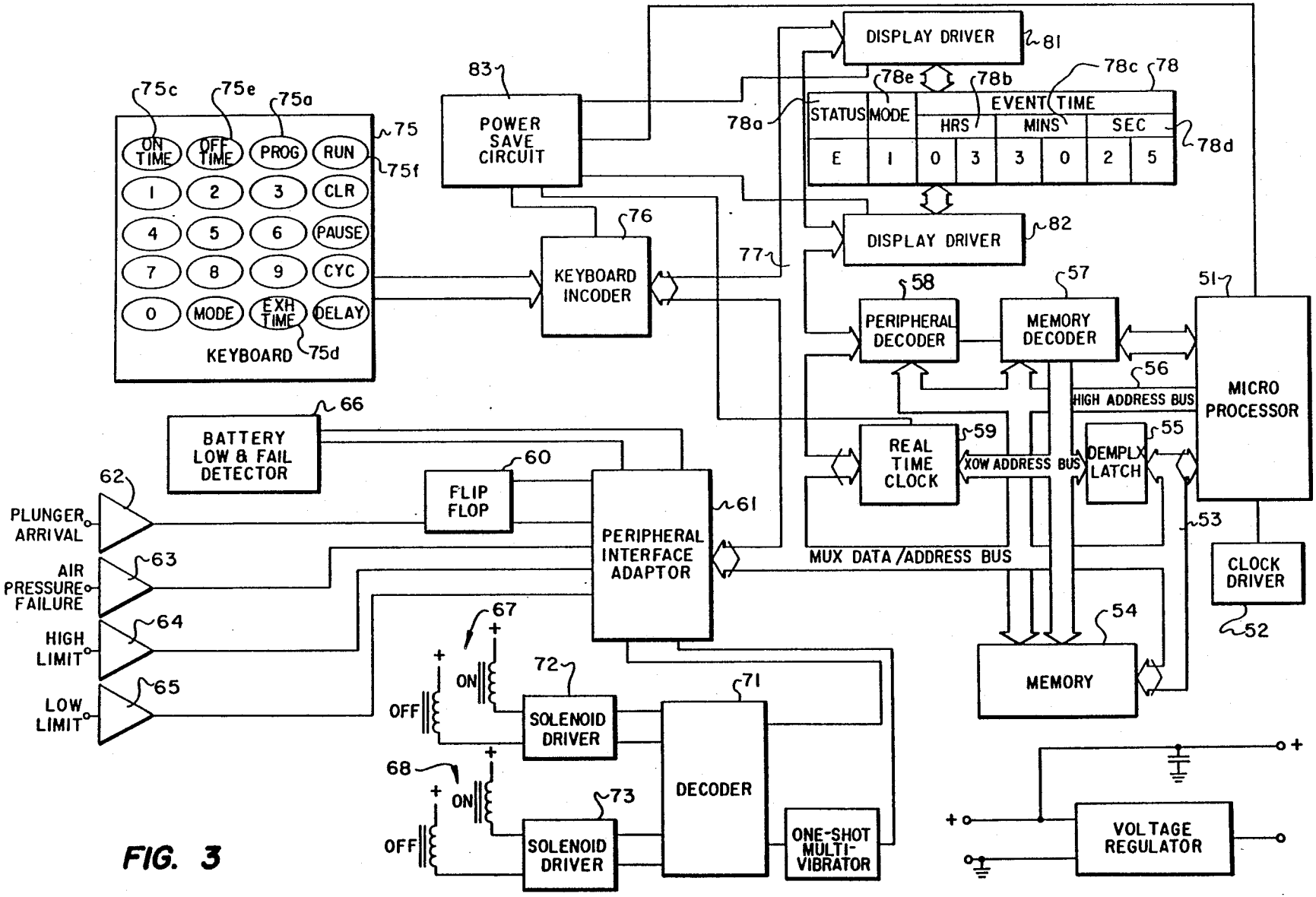
FIG. 3 is a block diagram of an electronic controller used in conjunction with the systems shown in FIGS. 1 and 2.

Referring now to FIG. 3, there is shown a block diagram of a well production controller 26 which can effect the operation of the well completions illustrated in FIGS. 1 and 2. The circuitry includes a micro-processor 51 driven by a clock driver 52 and connected via a multiplexed data/address bus 53 to a memory 54 and a demultiplexing latch 55. The processor 51, as well as other processors referred to herein, is preferably of the "CMOS" type and, by way example only, a National Semiconductor model NSC-800N-1 CMOS micro-processor has performed satisfactorily. The micro-processor 51 is also connected through an address bus 56 and a memory decoder 57 to the memory 54 and to a peripheral decoder 58 and a real time clock 59. Finally, the micro-processor 51 is connected over the bus 53 to a peripheral interface adapter (PIA) 61.

The peripheral interface adapter 61 is connected to receive input from a plunger arrival sensor 30 (FIGS. 1 and 2) through an operational amplifier 62 and from an air pressure fail sensor through an associated amplifier 63. A high tubing pressure limit sensor provides a signal through amplifier 64 in the event the tubing pressure exceeds a pre-selected value while a low tubing pressure sensor provides a signal through amplifier 65 in the event the tubing pressure drops below a pre-selected value. In addition, since only battery power is available in the remote areas where such systems are most often located, the system is provided with a low battery voltage detector and a battery voltage failure detector 66 which provides information through the peripheral interface adaptor 61 to the rest of the system.

The peripheral interface adaptor 61 is connected to actuate a pair of motor valves by means of a pair of solenoids, one for "on" and one for "off" in each of the solenoids pairs 67 and 68. An address from the peripheral interface adaptor 61 is passed through a decoder 71 to one or the other of a pair of solenoid drivers 72 and 73 for respective ones of the motor valve solenoid pairs 67 and 68. A one shot multi-vibrator 74 selects the time period during which a signal is supplied to the solenoid drivers. The well controller system of FIG. 3 also includes a key-board 75 for the entry of multiple programming data into the memory 54 through a key-board encoder 76 and the bus system 77.

A multi-character optical display 78, preferably of the liquid crystal display (LCD) type, is provided for operator observation of information as it is programmed into the system as well as various parameters and items of data which can be monitored during the operation of the system. In addition, the display provides a visual alarm upon malfunction as well as visual indications of low battery voltage and a battery failure condition. The display 78 is driven through a pair of display drivers 81 and 82 in conventional fashion. In one embodiment of the display 78, each character can either be the numerals 0–9 or the letters H,E,L or P. A loss of solenoid air supply pressure effects closure of all motor valves and is visually indicated by the indication HELP then the numeral 1; a low battery alarm is indicated by the display which alternately flashes a blank display and the current time information; and a low battery effects closure of all motor valves and is shown by HELP 2. The status portion of the display **78*a*, indicates the condition of the cycle of operation of the circuit as either ON TIME-P; OFF-TIME-E; EXHAUST-TIME-L; or INJECT-TIME-H while the remaining time is shown and decremented in hours, minutes and seconds in display section 78*b*, 78*c* and 78*d*, respectively. The mode of operation of the controller is shown in section 78*e*: 1 for mode A (oil well mode); 2 for mode B (gas well mode); and 0** for mode C (a straight timing operation with no optimization).

To provide maximum battery life in remote locations, the system includes a power save circuit 83 which operates to power down all processor functions except those necessary to maintain memory until the occurrence of either the passage of a selected time period or the receipt of an input signal from the key-board 75.

In the operation of the system of FIG. 3 in the oil well mode as described above in connection with FIG. 1, programming entries are made by first depressing program key **75*a*, mode key 75*b* ; and thereafter the numeral 1 to select mode A (oil well mode) or 2 to select mode B (gas well mode). For example, to program a mode A operation the program key 75*a* is first depressed followed by the on-time key 75*c* and then numeral keys to program into the memory 54 a time indicative of the time period during which the motor valve is to be opened in the event that the controller does not receive a signal indicative of plunger arrival. Next, the program key 75*a* is depressed again followed by the off-time key 75*e* and numeral keys which are sequentially activated so that a second time is entered into the memory which is indicative of the initial time during which the first motor valve should be closed and the well shut-in. Each of the programming parameters are displayed in the LCD display 78 as they are entered into memory through key-board 75**. A mode B gas well operation is similarly programmed with the on-time tc open the first motor valve (a "maximum time" in the event the plunger does not arrive by then), and EXHAUST-TIME during which the second motor valve remains open to allow the free production flow of gas from the well, before the second motor valve is closed and the initial off-time period during which both motor valves are closed and the well remains shut-in.

Once the system is started by depressing the RUN key **75*f*, in mode A for example, the micro-processor 51 controls operation of the system to provide signals to the peripheral interface adapter 61, decoder 71, and one shot multi-vibrator 74 to energize the motor valve solenoid 67 and open the tubing at the wellhead. As soon as the controller receives a signal from the plunger arrival sensor through the operational amplifier 62, the flip-flop 60 and the peripheral interface adapter 61, the micro-processor causes the first motor valve solenoid 67** to close to shut-in the well and allow the plunger to return to the bottom of the well for recycling. At this time, the second off-time period is begun during which the well remains shut-in. This off-time should be a minimum of about one half hour to allow sufficient time for the plunger to return from the wellhead to the bottom of the tubing in the well. The period which is initially selected for programming of the off-time will be a function of observed characteristics of the well before installation of the controller. For example, when the well is initially shut in for the installation of the controller, the installers would observe the rate at which the casing pressure builds when the well is shut in and from that observation, select a time period during which, from experience, the operator is confident that sufficient casing pressure will accumulate to cycle the plunger given the depth of the well and its operating characteristics.

Once the controller has successfully cycled the well for the first time with the pre-selected initial off-time, during the next cycle the off-time is decreased by a pre-selected "delta time " to attempt to cycle the well with an off-time of slightly less duration. If this off-time is again successful at accumulating sufficient downhole casing pressure to raise the plunger all the way to the surface, the off-time is again decreased by a "delta time". This sequence is repeated to gradually locate the minimum off-time for the current operating conditions of the well by achieving the state in which the plunger does not quite reach the plunger arrival detector and the micro-processor 51 does not receive a signal from the peripheral interface adapter 61, the flip-flop 60 and the operational amplifier 62 indicative of plunger arrival at the surface prior to the expiration of the on-time period initially selected at the maximum time-out period allowed in the event the plunger did not arrive. Once the plunger has failed to arrive before time-out on a particular cycle, the micro-processor 61 then automatically closes the first motor valve and adjusts the off-time period to increase it slightly by a pre-selected value to attempt to again cycle the plunger as a result of the downhole pressure having build-up over a slightly increased off-time period. In the event the system is then successfully cycled and a plunger arrival signal is received from operational amplifier 62 before time-out on the next cycle, the controller again attempts to decrease the off-time period by a delta-time. In this way the controller functions to maintain a constant balance of continuing to decrease the off-time period to the very minimum allowable for cycling of the plunger. It should be noted that the delta times by which the off-time is decreased on each cycle are relatively small so that in the event the plunger does not completely reach the plunger arrival sensor, it can be confident that it very nearly reached the sensor and, as a result, unloaded the vast majority of the load of fluid which it was carrying to the surface on that particular cycle. Thus, the failure of the plunger 20 to fully reach the surface does not create a serious risk of loading the well.

In the event that the system is unsuccessful for two successive cycles in having the plunger arrive at the surface and the micro-processor 51 receive a signal from the plunger arrival operational amplifier 62 within the pre-selected time-out period, it substantially increases the length of the off-time to virtually guarantee that the plunger will cycle on the very next time period to eliminate the danger of loading the system from inadequate off-time pressure build-up.

In the event that the system is operating in the mode B configuration whereby the gas well mode is desired, the key-board 75 is used to select PROGRAM, MODE, and the numeral 2 and, thereafter, program the "exhaust-time" period during which high pressure gas production flow is to occur, followed by the "on-time" allowed for clearing of the well in the event the plunger does not arrive, as well as the "off-time" during which the well is to be fully shut-in to allow formation pressure to accumulate. Upon initiation of the cycle by depression of the RUN key 75*f*, the micro-processor delivers a signal through the peripheral interface adapter 61, the one shot multi-vibrator 74, and the decoder 71 to open the first motor valve 67. When a signal is received over the plunger arrival sensor through the operational amplifier 62, the flip-flop 60 and the peripheral interface adapter 61, the micro-processor again causes the first motor valve 67 to close and, simultaneously, the second motor valve 68 to open for a pre-selected "exhaust-time" period of high pressure production flow. Thereafter, both motor valves 67 and 68 are closed for a pre-programmed "off-time" period and the cycle is again repeated. On the next cycle the micro-processor increases the length of the exhaust-time by a small incremental delta-time to increase the length of time during which production gas flow is obtained from the well. When the well continues to successfully cycle on the next time period and the plunger reaches the surface to produce a plunger arrival signal through operational amplifier 62, the micro-processor again increases the length of the exhaust-time by a pre-selected delta-time period. When the plunger does not reach the surface and the microprocessor does not receive a signal from the peripheral interface adapter 61, flip-flop 60 and operational amplifier 62, during the maximum "on-time" period set for arrival of the plunger, it automatically closes both the motor valves 67 and 68, skips the "exhaust-time" period and decreases the length of the exhaust time for the next cycle by a pre-selected "delta-time" value to ensure that on the next cycle the system will have sufficient downhole pressure to enable the plunger 20 to completely reach the surface. When the system has again successfully cycled the plunger and has reached the surface, the exhaust time is again increased by delta-time to attempt to length the maximum time during which flow is obtained from the well and still be able to cycle the plunger with the selected off-time. In the operation of the circuitry of FIG. 3 in connection with the gas lift completion of FIG. 2, the operation is similar.

In addition to controlling the length of the off time of the well to increase the number of trips the plunger may make within a pre-selected time period for oil well operation and/or the length of flow time for gas production flow from the well in the case of a gas well, the system serves to reduce the minimum amount of inject time from the gas inject system and thereby conserve the gas required to lift the plunger and cycle the well.

Figure 5A:
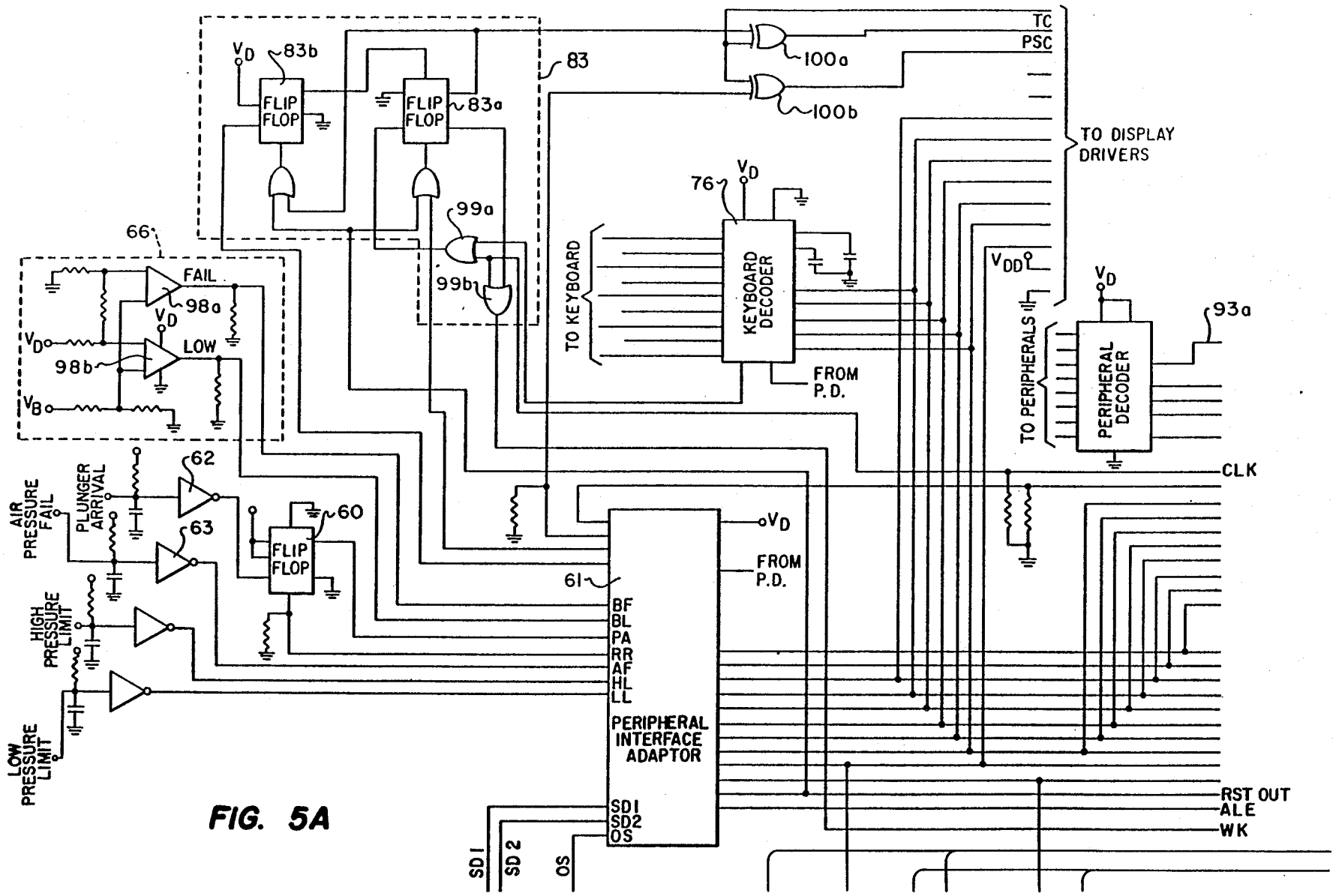
FIGS. 5A, 5B and 5C are each portions of a schematic diagram of an electronic controller constructed in accordance with the invention and shown in FIG. 3.
Figure 5B:
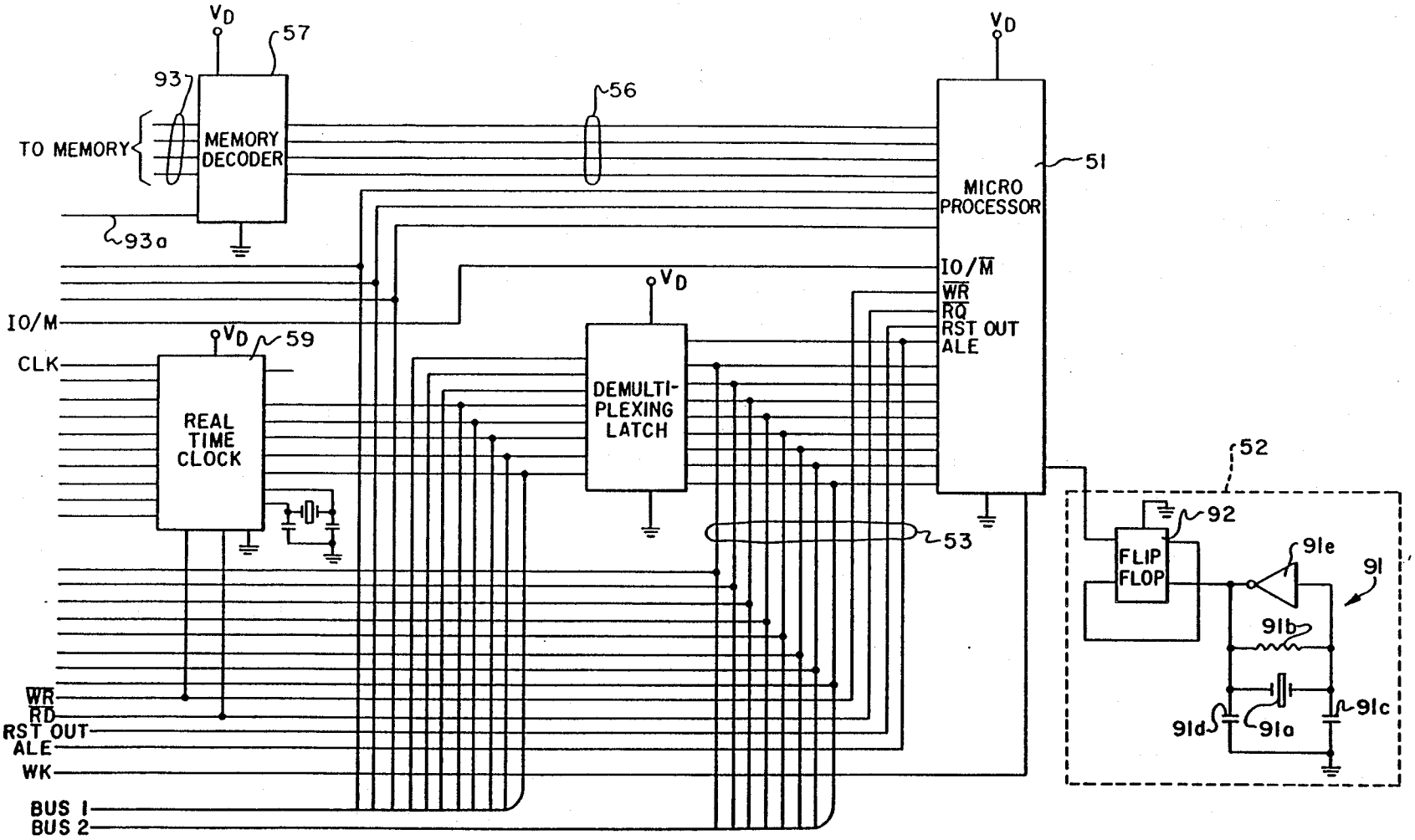
Figure 5C:
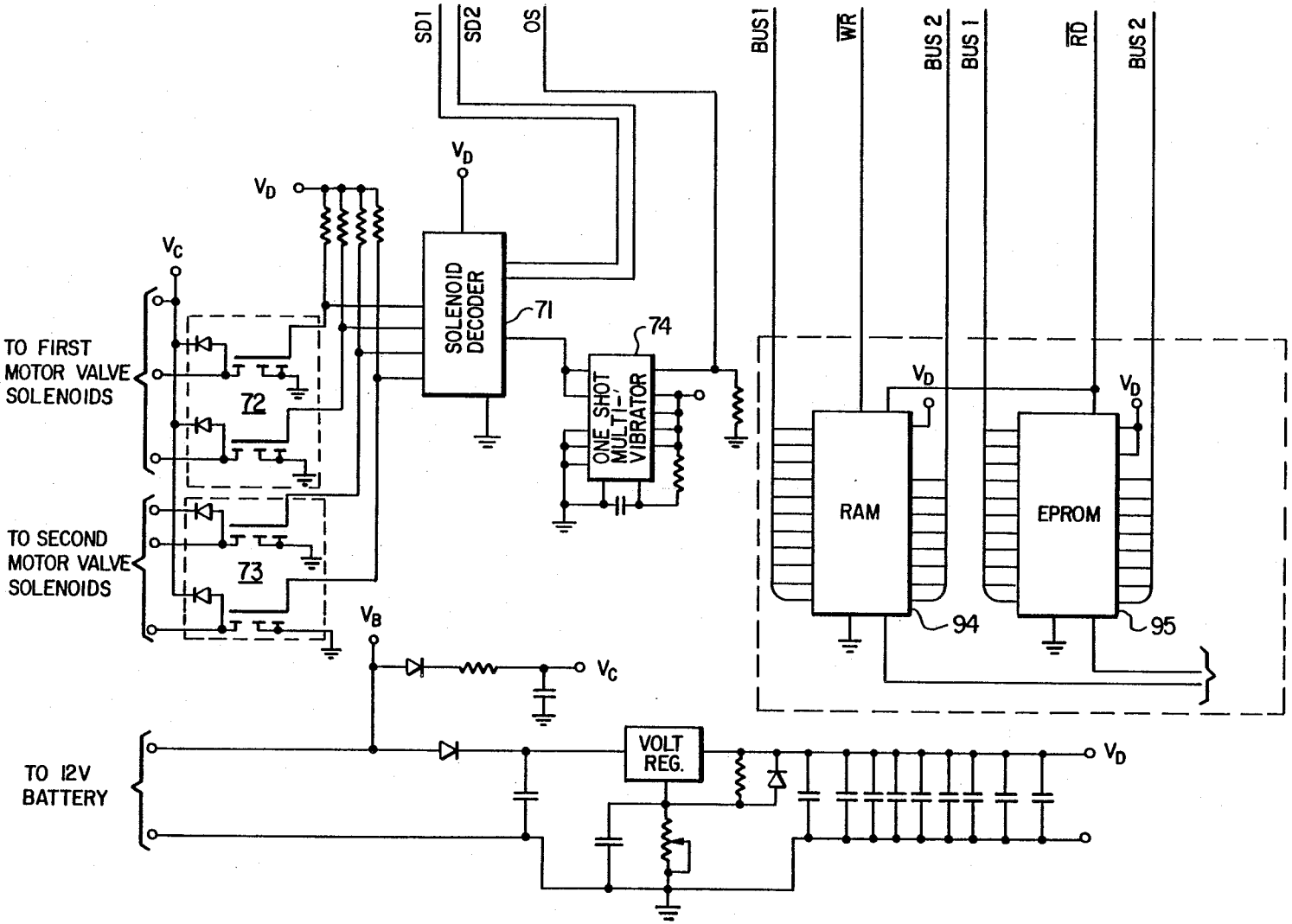

Referring next to the schematic diagram shown in FIGS. 5A, 5B and 5C, arranged for viewing as shown therein, the microprocessor 51 is connected to be driven by a 500 $KH_z$ clock driver 52 comprising an oscillator 91 connected through a flip-flop circuit 92. The oscillator 91 includes a 1 $MH_z$ crystal 91*a* across which is connected a resistor 91*b*, a pair of capacitors 91*c* and 91*d* and an inverting amplifier 91*e*. The micro-processor 51 is connected to the memory decoder 57 by leads comprising the address bus 56. The output of memory decoder 57 is connected to the memory 54 by address leads 93 and connected to the peripheral decoder 58 by a single lead 93*a*. The output of the microprocessor 51 is also connected by means of data and address bus 53 to a number of other components including the memory 54, the real time clock 59 the display drivers 81 and 82 (FIG. 3), as well as the key-board encoder 76 and the peripheral interface adapter 61. A memory decoding latch 57 is provided to demultiplex the data and address buses from the output of the micro-processor 51. The memory 54 includes RAM memory 94 for the storage of measured parameters and key-board selectable programmed data, as well as an EPROM 95 for the storage of program control for the micro-processor 51. The key-board encoder 76 is connected to the key-board 75 (FIG. 3) to input data from the key-board into the memory 54 as well as the optical display 78 for observation by the operator. The output of the peripheral interface adapter 61 is connected to both a solenoid decoder 71 as well as through a one-shot multi-vibrator 74 to energize the solenoids for a pre-selected time period. A pair of solenoid drive circuits 72 and 73 are connected to "on" and "off" solenoids for each of the two motor valves.

The power save circuit 83 consists of a pair of interconnected flip flops 83*a* and 83*b* having OR gates connected to each other by their reset leads. An output from the key-board encoder 76 through OR gate 99*a* is coupled to the first flip flop 83*a*. An output from the real time clock is also connected via the CLK lead to the other input of OR gate 99*a*. An output from the set lead of flip flop 93*a* is connected through another OR gate 99*b* back to the micro-processor as the WK lead. Output from the flip flops 83*a* and 83*b* are connected through a pair of EXCLUSIVE OR gates 100*a* and 100*b* which are connected to drive the display. One of the gates 100*a* is connected to drive the time colon which flashes on and off while the unit is in operation while the other gate 100*b* is connected to a "power save" colon which burns steady when the system is in power save mode and indicates that minimum power is being consumed. In power save mode, all processor and analog functions are powered down except those necessary to maintain memory and essential digital operation to conserve power. In the event of a signal from either the key-board decoder 76 or the real time clock 59, which produces a signal on the CLK lead once each second, is received through gate 99*a*, the power save circuit is switched out of power save mode and power is delivered to all the components for operation and evaluation of the status of the system.

Figure 4:
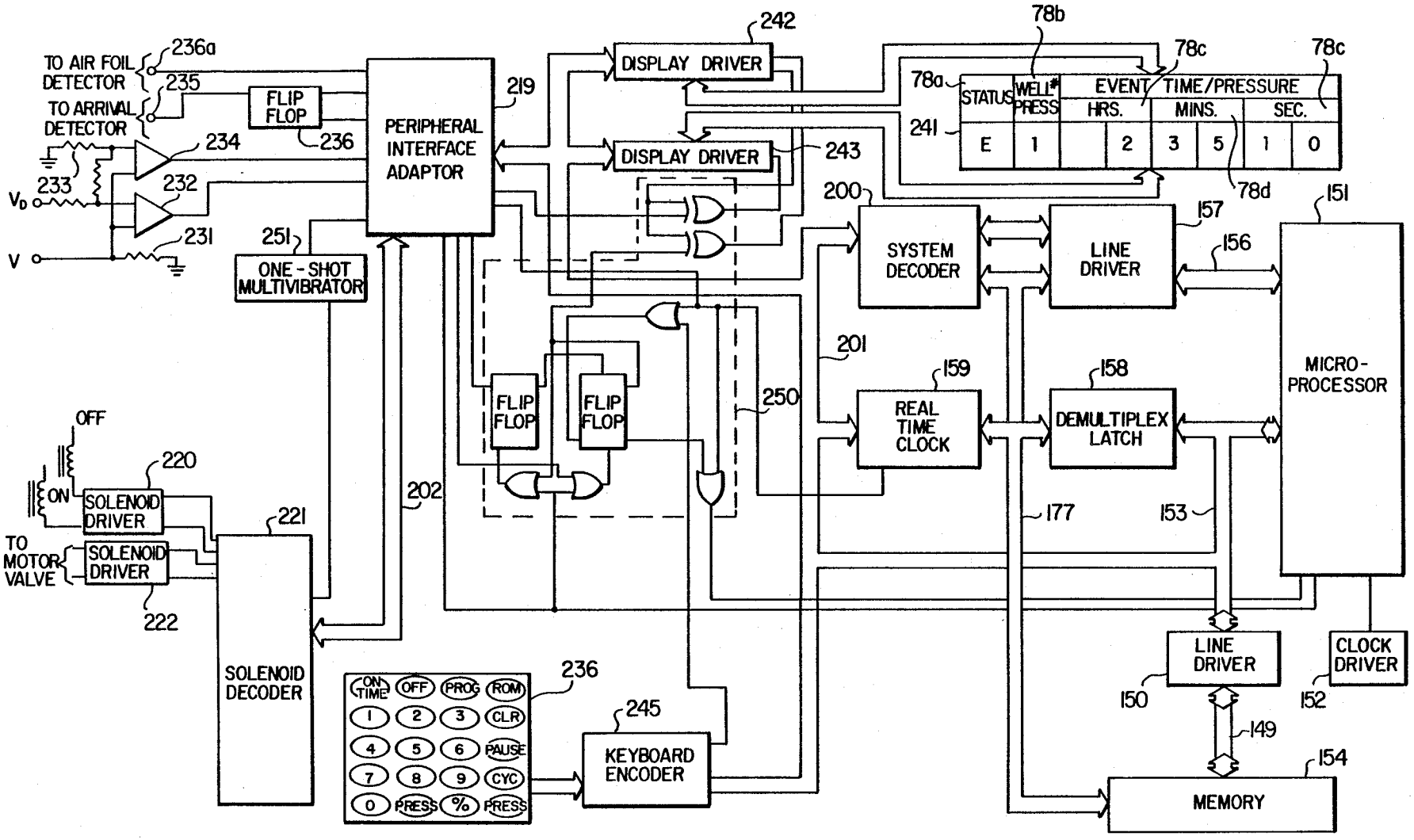
FIG. 4 is a block diagram of an electronic controller used in conjunction with the systems shown in FIGS. 1 and 2.

Referring now to FIG. 4 there is shown a block diagram of a system also constructed in accordance with the present invention for the operation of the well control system shown in FIGS and 2. In particular, the system includes a microprocessor 151 driven by a clock driver 152 which is connected to a line drive 157 by means of an address bus 156. The microprocessor 151 is also connected by means of a data and address bus 153 through a line drive 150 to a memory 154. In addition, the micro-processor 151 is connected to a demultiplexing latch 158, the output of which is connected to the memory 154 via the bus 177 as well as to the real time clock 159 and the system decoder 200. A bus system 201 connects the system decoder and the real time clock 159 to a keyboard encoder 245.

A peripheral interface adapter 219 is provided and the output of which is connected through a bus 202 to a solenoid decoder 221 connected to actuate one of the pair of solenoid drivers 220–222 which control the motor valves in the system. A low digital battery voltage detection network 231 is connected through an operational amplifier 232 to the input of the peripheral interface adapter 219 while a dead battery detection network 233 is connected through an operational amplifier 234 to another input of the peripheral interface adapter 219. A plunger arrival terminal 235 is connected to a plunger arrival detector (FIGS. 1 and 2) and provides a signal through a flip flop 236 to indicate to the peripheral interface adapter 219 the arrival of a plunger at the upper portion of the tubing. An air pressure failure detector is connected to terminal 236*a* and provides a signal to the peripheral interface adapter 219 in the event of a failure of a compressed air supply used to operate the motor valves.

A multi-character liquid crystal display 241 is provided with a pair of display drivers 242 and 243. A bus system 201 interconnects the display drivers 242 and 243 to a key-board encoder 245 which decodes a keyboard 236 to display information encoded by the keyboard into the memory 154. Further, the optical display 241 may be utilized to observe various items of memory such as previously programmed times. The components within the power save circuit 250 which are adapted to reduce the power consumption of the controller during most of the timed operation of the system. That is, the power save circuit 250 operates to power down all of the non-essential functions which consume power until a signal is received either from the real time clock on a periodic basis or from a key-board entry indicative that the system is being programmed or queried for information. Either these two events serve to power up the system to see if any action needs to be taken.

Figure 6A:
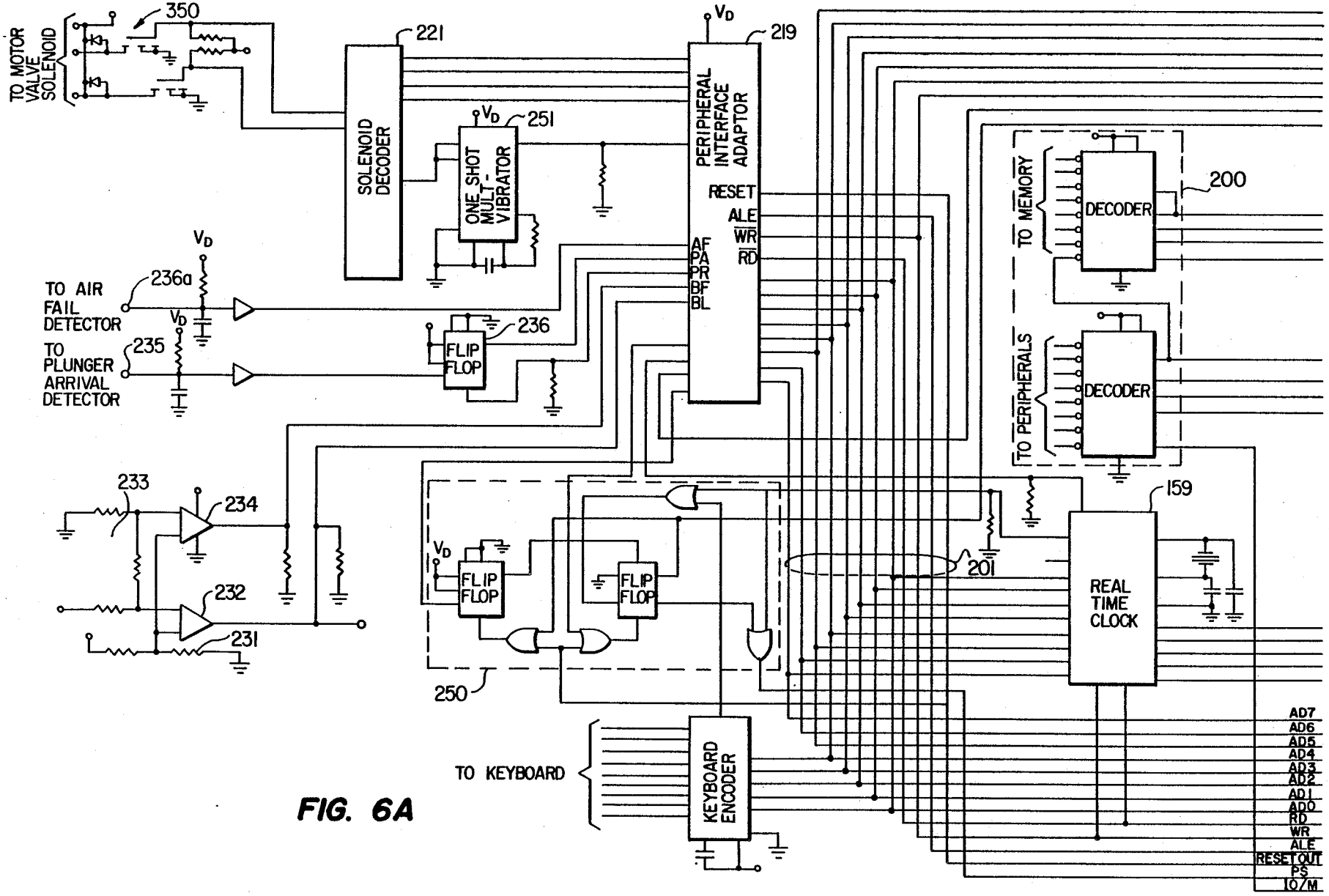
FIGS. 6A, 6B and 6C are each portions of a schematic diagram of an electronic controller constructed in accordance with the present invention and shown in FIG. 4.
Figure 6B:
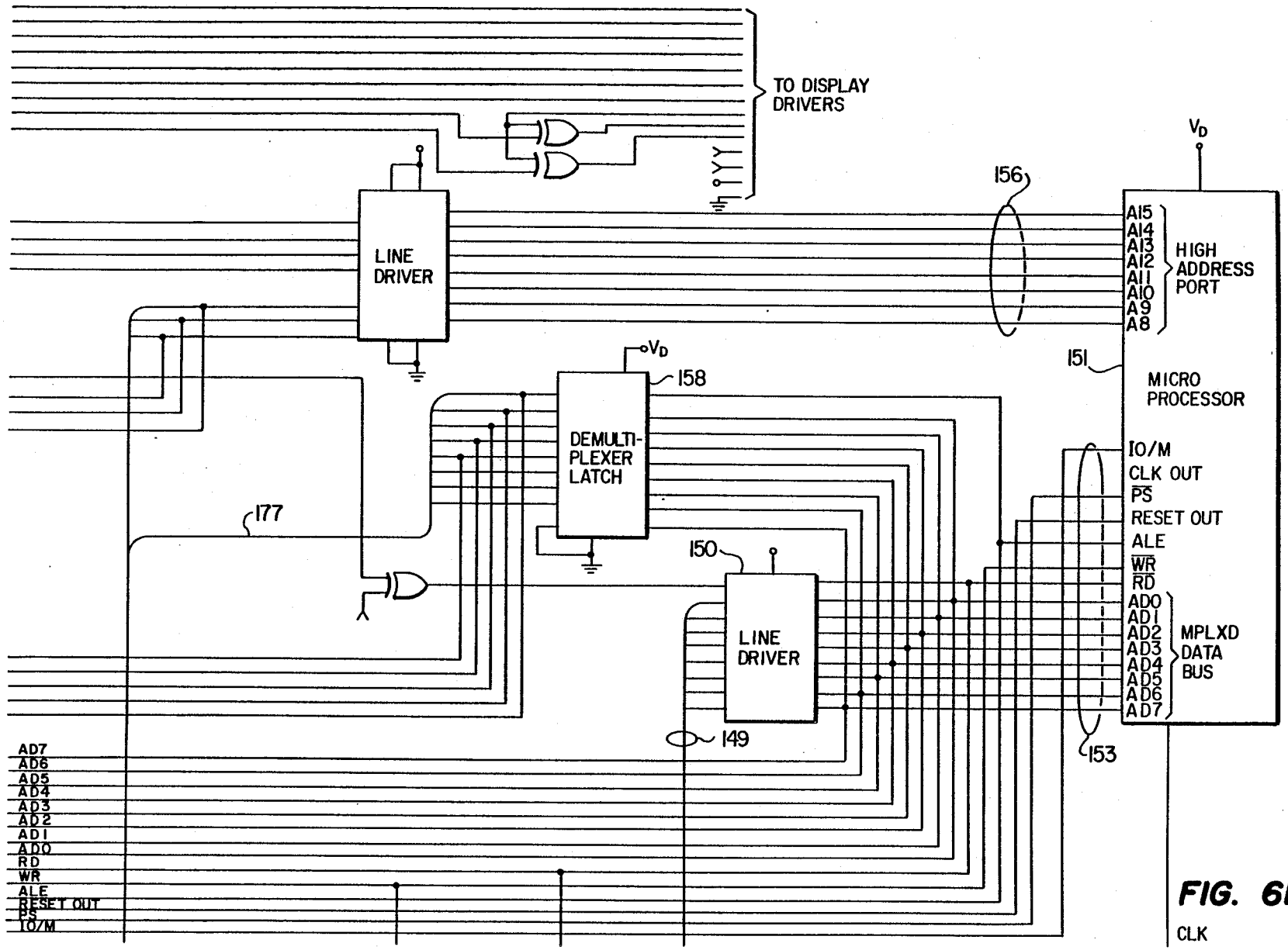
Figure 6C:
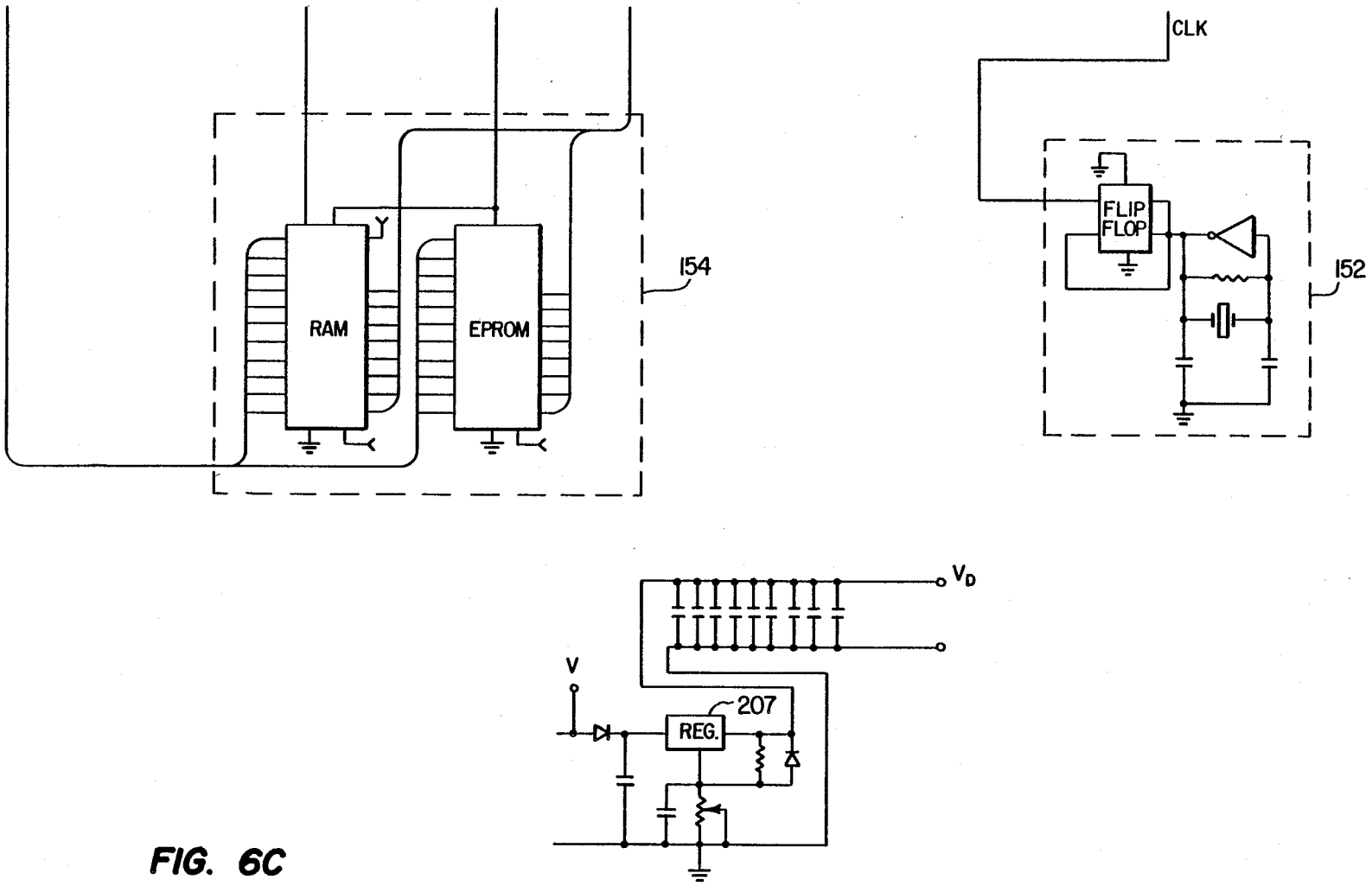

Referring now to FIGS. 6A–C, there is shown a schematic diagram of the system illustrated in block form in FIG. 4. As can be seen, a clock driver 152 drives a micro-processor 151 preferably of the CMOS type. Output from the micro-processor 151 on the address bus 156 is provided to the line dive 157 and MULTIPLEXED data both into and out of the micro-processor 151 flows over the data bus 153. Line drivers are provided at 150 to move information into and out of the memory 154 which consists of an RAM together with an EPROM storage unit. A demultiplexing latch 158 is provided on the data bus to demultiplex the output from the micro-processor 151. The latch 158 is connected to the real time clock 159 via bus 177 as well as the memory 154. Outputs from the system decoder 200 go both to the memory 154 as well as to the peripheral interface adapter 219. The multiplex data bus 201 carries data, address and control information among each of the peripheral units such as the real time clock 159, the key-board encoder 235 as well as the peripheral interface adapter 219. Digital battery condition is measured by network 231 and a differential amplifier 232 while dead digital battery condition is detected by network 233 and operational amplifier 234 communicated to the peripheral interface adapter 219.

Solenoid driver circuits 350 are connected to the peripheral interface adapter 219 which drives through a one-shot multivibrator 251 and a solenoid decoder 221 to power a plurality of motor valve solenoid drivers 350. An air pressure failure signal on lead 236*a* provides an indication to the peripheral interface adaptor 219 while a plunger arrival signal on terminal 235 provides an indication through adapter 219. In particular, the circuit operates to provide systematic operation of the well configurations shown in FIGS. 1 and 2.

Figure 7A:
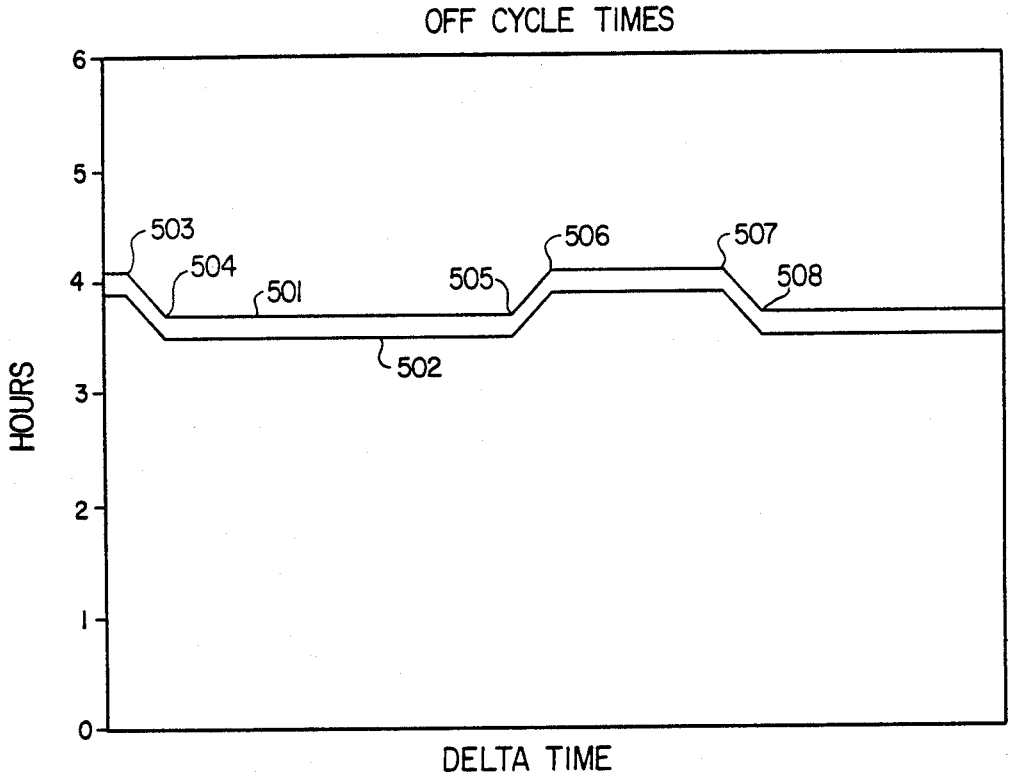
FIG. 7A is a graph illustrating the operation of the system of the present invention with a plunger completion oil well.

Referring next to FIG. 7A, there is shown a graphical presentation of the envelope of operation within which the system of the present invention optimizes the production of an oil well. Along the vertical side of the graph is the off cycle times given in hours while along the horizontal dimension of the graph is delta time given in weeks. As can be seen in the graph, the uppercurve shows an illustrative upper limit of off cycle time for optimum production while the lower curve 502 shows an illustrative lower limit of off cycle times for optimum production. That is, time periods fall on or above the upper curve 501 are the ideal optimum off-time periods for production of the oil well based upon the off cycle times. It can be seen at points 503–508 that there were major changes in the illustrative optimum time period which were produced by perturbations either in the well, the reservoir into which the well penetrates or in the delivery system downstream from the well into which the fluid is being delivered. Similarly, the same perturbations produce an analogous change in the illustrative lower limits for optimum off time periods for maximum production from the well. This graph illustrates the difficulty inherent in attempting to base the intermitting of the well purely upon fixed time periods or even upon some attempt at defining an algorithm which describes the operation of the well over a long enough time period to ensure that the algorithm will consistently continue to predict the optimum periods for maximizing production from the well.

Figure 7B:
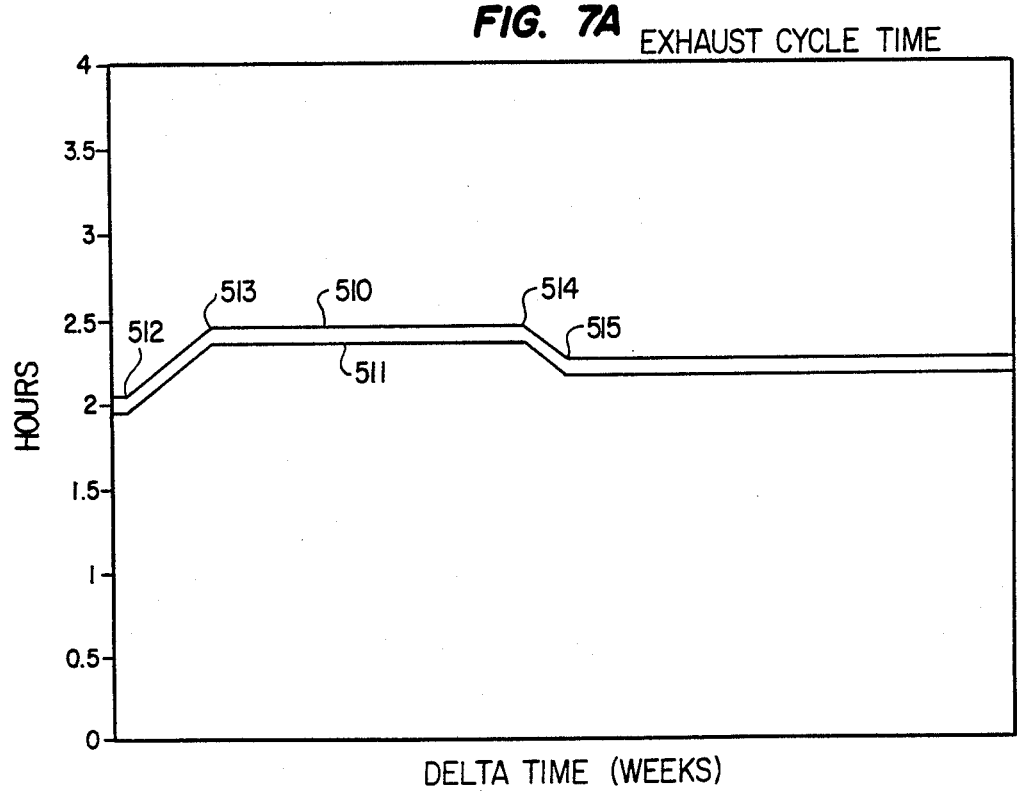
FIG. 7B is a graph illustrating the operation of the system of the present invention in conjunction with a plunger completion gas well.

Referring now to FIG. 7B, there is shown a graph of illustrative exhaust cycle times of a gas well designed to optimize the production from the well. As can be seen in FIG. 7B, the upper curve 510 defines an illustrative upper limit on the exhaust time while the lower curve 511 defines an illustrative lower limit on exhaust cycle time in order to achieve optimum exhaust time gas flow from the well. As can be seen at the points 512–515, there occurred illustrative changes which affect the production from the well as a result in changes in the characteristics of the well and which must be taken into account by varying the maximum time during which production flow can be obtained from the well.

Figure 8A:
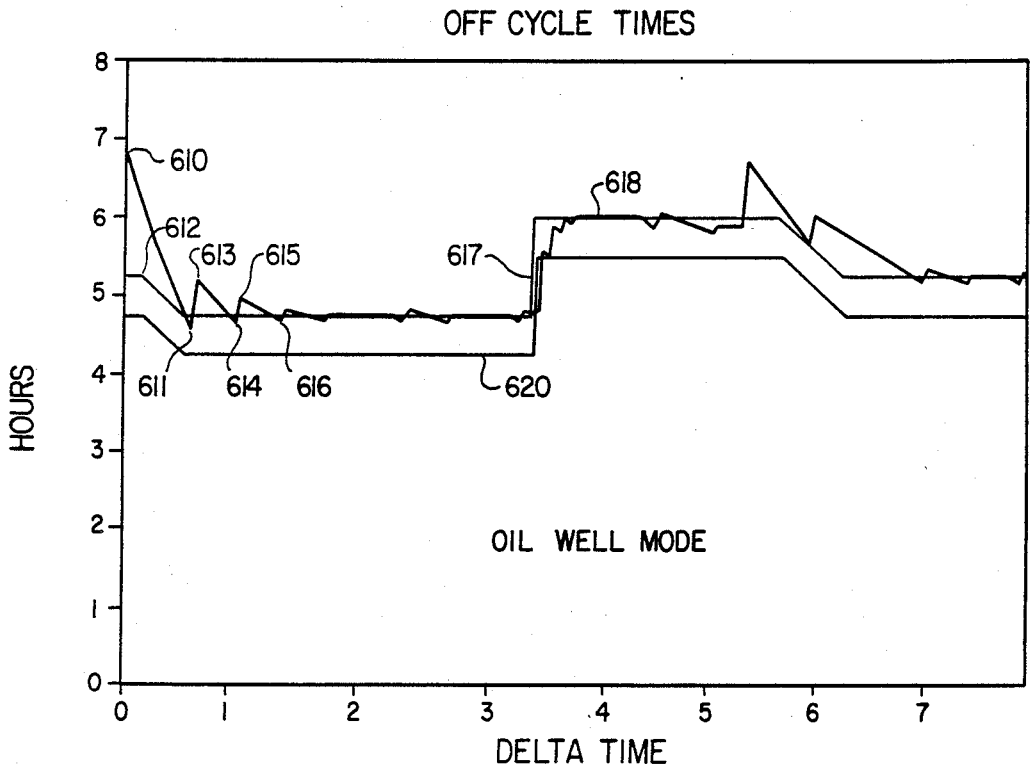
FIG. 8A is a graph illustrating the successive changes in the length of the off time periods during the operation of a plunger completion oil well by the system of the present invention.

Referring next to FIG. 8A, there is shown an illustrative graph of the off times of the system of the present invention operated in the oil well mode. This graph serves to illustrate the manner in which the controller of the present invention continually decreases the length of the off cycle time periods by incremental values over the period of operation to attempt to achieve optimum fluid production from the well. As shown in FIG. 8A, the vertical axis of the graph illustrates off-time periods in hours. The horizontal axis of the graph illustrates the passage of time over a period of days or weeks and includes numerous cycles of the intermitting of the well. Point 610 on the graph illustrates the fact that the initial off time selected for a well is fairly large to ensure that when the operation begins, the well will be sure to cycle the plunger and not run any risk of loading up. During the number of cycles between the points 610 and 611, e.g., 12 cycles, the length of the off-time period on each successive cycle is gradually reduced in value by increments from around 7 hours to less than 5 hours. When the time period becomes less than the curve 612 representing the upper limit of the length of off-time period following which the plunger is sure to reach the surface, the plunger failed to cycle. On the next cycle, the off time, represented at point 613, was increased to greater than 5 hours to ensure that the plunger would reach the surface when the well was opened and the well would cycle. Thereafter, once the off-time was increased to a value where the well was cycling between points 613 and 614, the controller continued to decrease the off-time period during each successive cycle of the well until it again reached a point, at 614, at which the plunger would not cycle. In response the controller introduced a step function incremental increase in the off-time period at 615 to ensure that the plunger would again cycle. Thereafter, once the well cycled again, the off time period employed was again gradually decreased from cycle to cycle between 615 and 616 as the system zeroed in on the optimum off-time period for well conditions existent at that time to achieve the maximum number of trips of the plunger in a given time period and still ensure that the well would cycle each time. This ideal off-time period, which continues to change as well, reservoir and gathering system conditions vary, is represented by the upper line 612. The lower line 620 represents the theoretical off-time periods for the well for which the plunger is sure not to cycle. Off-time periods falling in the space between them may or may not cause the plunger to cycle. Thus the controller continually searches for an off-time lying on the ideal upper line 612.

Still referring to FIG. 8A, at point 617, there is represented a step function change in well condition parameters which are caused by some perturbation in either the well, the formation or the gathering system to which the well is connected This change in conditions is reflected in a change in both the minimum and maximum limits on off-time for cycling of the well. The system responds to this illustrative change in operating conditions by increasing the off-time periods to ensure that after a number of cycles the system is again zeroed in on the new ideal upper limit 618. It can be noted at 617 that following two successive cycles during which the plunger failed to reach the surface the controller introduced a large increase in off-time period to be sure the plunger cycled the very next round to avoid loading the well. The controller operates to ensure that the system is making as many cycles of the plunger as possible and still sure to cycle the well.

Figure 8B:
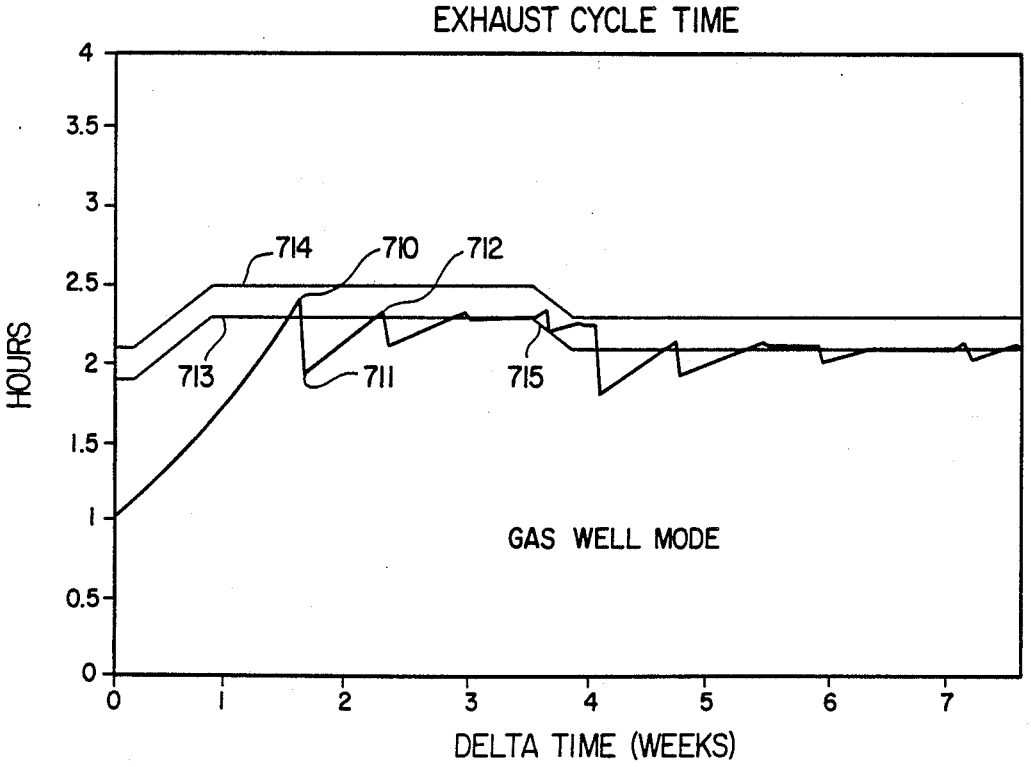
FIG. 8B is a graph illustrating the successive changes in the length of the flow time periods during the operation of a plunger completion gas well by the system of the present invention.

Similarly, in FIG. 8B, there is also shown a graph of an illustrative operation of the controller in the gas well mode of the system of the present invention. In FIG. 8B, the vertical axis of the graph represents exhaust time periods of the well in hours while the horizontal axis represents the passage of time over a period of weeks and includes numerous successive cycles of intermitting of the well. As can be seen in the graph of FIG. 8B, an initial illustrative exhaust time period of about 1 hour is selected to ensure that the well will not load up. Thereafter, over a period of time, the exhaust time for the well is gradually increased until at point 710 the exhaust time was so large that the well would no longer cycle for the selected off-time and operating conditions at that time. In response, the exhaust time is decreased by the controller on each successive cycle between 710 and 711 to be sure that the exhaust time is not too great to ensure that the well will cycle each time. Once the length of the exhaust time period is decreased to the value shown a point 711 and the plunger is reaching the surface after the well is opened, the exhaust time is gradually lengthened again between points 711 and 712 to attempt to achieve the optimum length of exhaust time and still have the well to reliably cycle. The lower limit on the length of the exhaust time period following which the well will be sure to cycle given the particular operating conditions at the time is represented by ideal line 713. The upper limit of exhaust time following which the plunger is sure not to reach the surface is represented by line 714. Exhaust times which fall between curves 713 and 714 may or may not result in complete cycling of the plunger. As can be seen, the ideal exhaust time periods for the well will lie along the lower curve 713. At point 715, there is represented an illustrative change in the operating parameters of the well and thus the ideal exhaust time. This change in conditions causes the controller to begin implementing a sequence of incremental increases in length of the exhaust periods on each cycle while continuing to monitor whether the well continues to cycle following each increase.

As can be seen from the graph of FIG. 8B, the controller continually tries to maximize the length of the exhaust time periods while ensuring that the well continues to cycle. It does this by incrementally increasing the length of each successive exhaust time period until that value reaches the point where the well will no longer cycle and then backing off and again trying to zero in on the ideal exhaust time for optimum production flow and continuous cycling of the plunger.

Software

Figure 9A:
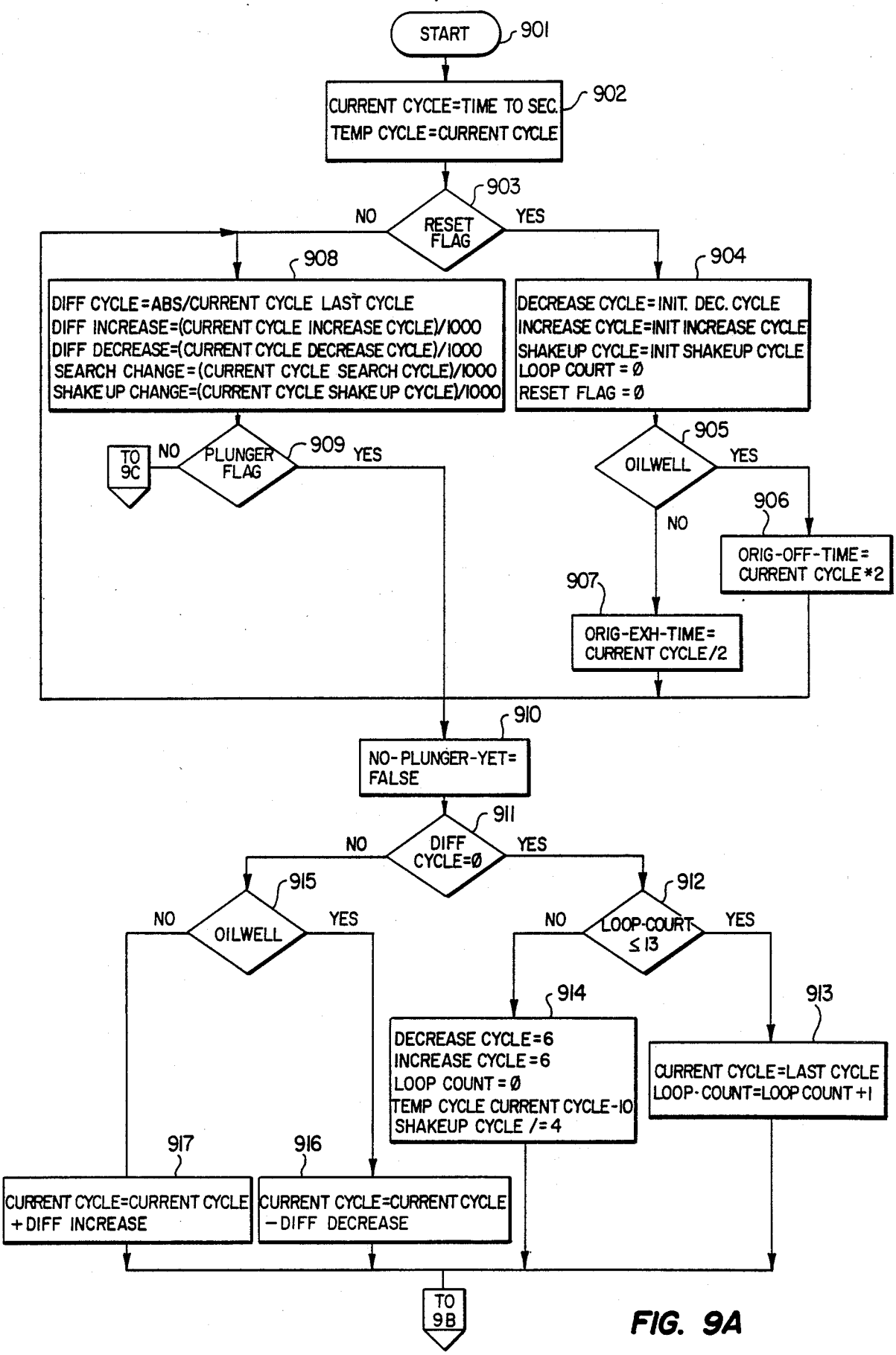
FIG. 9A, 9B and 9C are flow charts illustrating the programmed operation of an electronic controller constructed in accordance with the present invention.
Figure 9B:
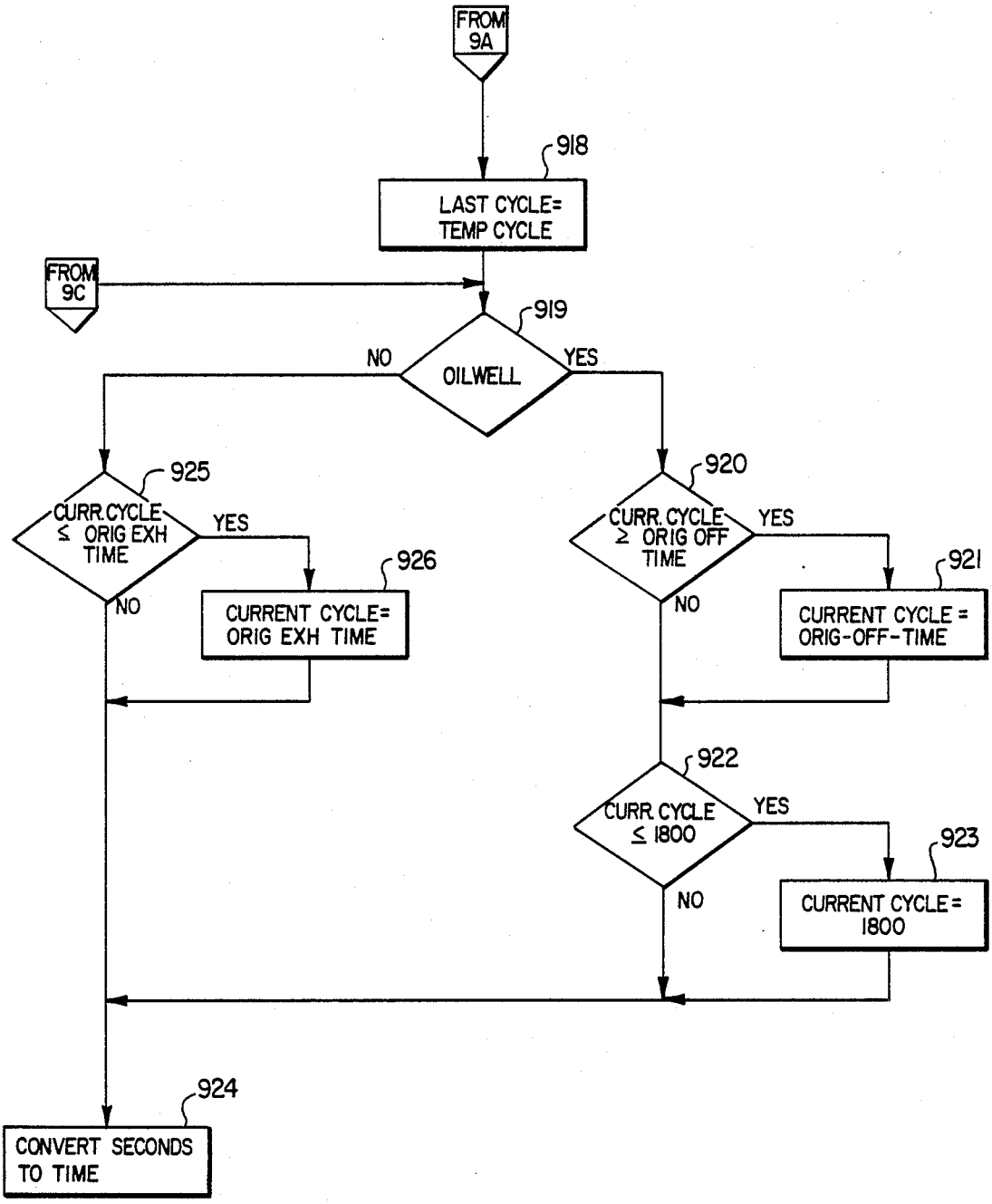
Figure 9C:
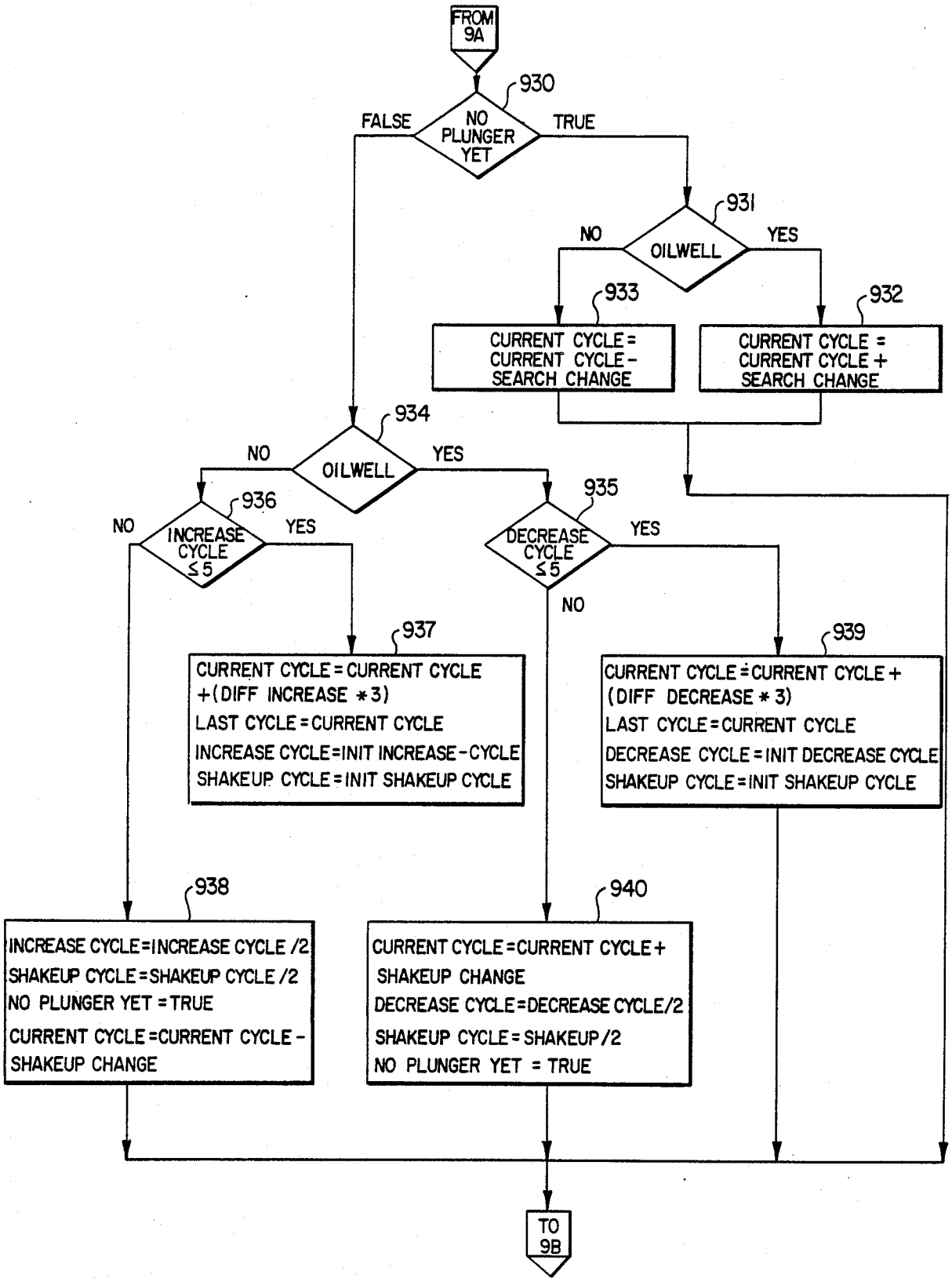

Referring next to FIGS. 9A-9C, there is shown a flow chart of the programmed operation of the system of the present invention. The flow chart begins at 901 and at 902 two operations occur. First, the current cycle time is converted into seconds for further calculation and handling within the program. Second, the current cycle time is set equal to a temporary cycle storage value. The current cycle value is dependent upon which mode the program control is in. If the system is in mode A to optimize production from an oil well, the controller is trying to optimize the "off time" of the well and therefore the current cycle is the off time. If however, the system is in mode B for a gas well, the controller is trying to increase the exhaust time for the system and thus the current cycle is "exhaust time". Next, at 903, the system checks to see whether or not a reset flag has been set. The presence of a reset flag, i.e., being equal to one, means that the system has not been through the loop before. If it is the first time through the loop then the system sets some initialization variables, for example, different values of percentages by which to increase of decrease time periods of the system.

If the reset flag is equal to 1 and it is the first time around for the system, it moves to 904 at which several actions are taken. First, the system sets up certain percentage value for the parameters "decrease cycle", "increase cycle", and "shake-up cycle" (the degree of change necessary to ensure that the plunger cycles). In addition, the system also sets a re-set flag to zero indicating that the system has now been through the loop for the first time.

Next at 905, the system inquires whether or not it is programmed in mode A, oil well mode, or mode B, gas well mode. If it is in mode A for oil well, the answer to the query at 905 is yes and the system moves to 906. In mode A, the controller knows that it is dealing with off time and the upper limit of off-time is set equal to two times the cycle time because it is the first time through the loop. If, however, the system recognizes at 905 that mode B is selected and a gas well is being operated, it moves to 907 knowing that it is desirable to optimize the exhaust time of the well and the initial exhaust time to set equal to the current cycle time divided by 2. These two values, obtained in steps 906 and 907, are the limits on the maximum amount of change in the off times and exhaust times, respectively, which can take place during any individual cycle.

Following either step 906 or 907, the system moves to 908 at which certain basic calculations are performed. First, the controller calculates a DIFF CYCLE value as the absolute value of current cycle minus the last cycle. That is, the current time is the time required on the last cycle actually measured. The last cycle was the time before that. If the absolute value is approximately 0 then the system has optimized itself. Next, a DIFF INCREASE value is calculated as being equal to the current cycle time times the increase cycle value and divided by 1000. This technique keeps the calculation in integer numbers rather than working with floating decimal points. Next, at 908, a DIFF DECREASE value is calculated as being equal to the current cycle times the decrease cycle value divided by 1000. Next, a SEARCH CHANGE value is calculated a being equal to the current cycle times the search cycle divided by 100. Finally, a SHAKE UP CHANGE value is calculated as being equal to the current cycle times the shake up cycle value divided by 1000. The end products of each of these calculations is a "delta time", that is, a time change value.

After the calculations are performed at 908, the system moves on to 909 at which point the controller checks to see whether or not the plunger flag is set. If the plunger has arrived at the surface and been detected, then the system sets a flag. If a plunger has arrived the system moves to 910 to set a false condition on the no plunger yet variable indicating that fact. Next, at 911 the system determines whether or not the DIFF CYCLE value is equal to 0. That is, has the system been optimized yet? If it has been optimized and the DIFF CYCLE value is equal to 0, the system moves to 912 to determine how many times the system has been through the cycle in an optimized condition. If it is less than or equal to 13, (which indicates an effective 15 cycles have been completed) the system holds the time periods the same. That is, if the loop count at 912 is less than or equal to 13 the system moves to 913 at which point the current cycle is set equal to the last cycle and the loop count is set equal to the loop count plus 1. If, however, at 912 the loop count is greater than 13, the system moves to 914 at which point several values are established: (a) the DECREASE CYCLE value is set equal to 6; (b) the INCREASE CYCLE value is set equal to 6; (c) the LOOP COUNT value is set equal to 0; (d) the TEMP CYCLE value is set equal to the current cycle minus 10; and (e) the SHAKE UP CYCLE value is divided by 4.

Returning to decision point 911 in the event the system is not optimized, and the DIFF CYCLE value is not equal to 0, the system inquires at 915 whether or not the system is in mode A for oil well or mode B for gas well. If an oil well mode exists, the system moves to 916 at which point the CURRENT CYCLE value is set equal to the CURRENT CYCLE value minus the DIFF INCREASE value. If, however, the system is in gas well mode, at 915, the controller moves to 917 at which point CURRENT CYCLE value is set equal to CURRENT CYCLE value plus the DIFF INCREASE value.

Moving on to FIG. 9B, after completion of points 913, 914 916 or 917, the system moves to 918, shown on FIG. 9B, at which point the LAST CYCLE value is set equal to the TEMP CYCLE value set at 902. Thereafter, the system moves to 919 at which point it again determines whether or not the system in mode A for oil well or mode B for gas well. If oil well, the system moves to 920 at which point it queries whether the CURRENT CYCLE value is greater than or equal to the original off time. If it is, the system moves to 921 at which the CURRENT CYCLE value is set equal to the original off time. If not, or after the CURRENT CYCLE value has been set equal to the original off time at 921, the system moves to 922 at which point it inquires whether the CURRENT CYCLE value is less than or equal to 1800. The value 1800 in seconds is equal to approximately 30 minutes, the minimum time required for the plunger to fall from the wellhead to the lower end of the tubing. If the CURRENT CYCLE value is less than or equal to 1800, then the system moves to 923 where the CURRENT CYCLE value is set equal to 1800. In either case, the system then moves to 924 where the current time in seconds is converted to real time for display.

Referring back to the query at 919, at which point the system was determined to be operating in mode B for a gas well, it then moves to 925 where the decision is made as to whether or not the CURRENT CYCLE value is less than or equal to the original exhaust time. If yes, the system moves to 926 at which the CURRENT CYCLE value is set equal to the original exhaust time. Following 926, or in the event of a no decision at 925, the system moves to 924 to convert the time value in seconds back to real time for display.

Referring back to 909 on FIG. 9A wherein it was determined that a plunger flag had not been set and thus a plunger had not arrived, the system moved to 930 on FIG. 9C to inquire whether or not the statement of no plunger yet was true or false. If true, the system moves to 931 at which point, if it is in oil well mode, the controller goes to 932 to set the CURRENT CYCLE value equal to CURRENT CYCLE plus the SEARCH CHANGE value. If, however, it is determined at 931 to be in gas well mode, the system moves to 933 at which the CURRENT CYCLE value is set equal to CURRENT CYCLE value minus the SEARCH CHANGE value. After either point 932 or 933, the system moves to 919 on FIG. 9B as described above.

If, however, at 930, the system determined that the no plunger yet query resulted in a false indication, the system moves to 934 and, if in gas well mode, thereafter to 936 at which point the system inquires whether or not the INCREASE CYCLE value is less than or equal to 5, that is, the 5 value represents ½ of 1 percent. If it is less than that, the system moves to at which point CURRENT CYCLE value is set equal to CURRENT CYCLE minus the DIFF INCREASE value times 3. In addition, at 937, the system sets: (a) the LAST CYCLE value equal to the CURRENT CYCLE value; (b) the INCREASE CYCLE value equal to the INITIAL INCREASE value; and (c) the SHAKE UP CYCLE value equal to the INITIAL SHAKE UP value. Thereafter, the system moves to 919 on FIG. 9B. If, however, at 936, the INCREASE CYCLE value was greater than 5, the system moves to 938 at which: (a) the INCREASE CYCLE value is set equal to the INCREASE CYCLE value divided by 2; (b) the SHAKE UP CYCLE value is set equal to SHAKE UP CYCLE value divided by 2; (c) the no plunger yet register is set equal to true; and (d) the CURRENT CYCLE value is set equal to CURRENT CYCLE minus the SHAKE UP CHANGE value. Thereafter, the system moves to 919 of FIG. 9B.

If at 935, the DECREASE CYCLE value in the oil well mode was less than or equal to 5, system moves to 939 at which: (a) CURRENT CYCLE value is set equal to CURRENT CYCLE value plus the DIFF DECREASE value times 3; (b) the LAST CYCLE value is set equal to the CURRENT CYCLE value; (o) the DECREASE CYCLE value is set equal to the INITIAL DECREASE CYCLE value; and (d) the SHAKE UP CYCLE value is set equal to INITIAL SHAKE UP CYCLE. Thereafter, the system goes to 919 at FIG. 9B. Finally, if at 935, the DECREASE CYCLE value in the oil well mode is greater than or equal to 5, the system moves to 940 at which: (a) the CURRENT CYCLE value is set equal to CURRENT CYCLE value plus the SHAKE UP CHANGE; (b) the DECREASE CYCLE value is set equal to DECREASE CYCLE divided by 2; (c) the SHAKE UP CYCLE value is set equal to SHAKE UP CYCLE divided by 2; and (d) the no plunger yet condition register is set equal to true. The system then, similarly, moves to 919 shown on FIG. 9B.

Thus, it can be seen that by a systematic processing of data through the analytical consideration of which cycle the system is in, the changes made since the LAST CYCLE value, and the other parameters within the system, the controller of the invention. continually moves the Well, When in an oil well mode. toward a decreasing of the off time and hence an increasing of the amount of production received from the well. If in the gas well mode, the controller continues to increase the exhaust time to maximize the production from the well. In the event that the system reaches a point at which it is not cycling the plunger, it either increases the off time or decreases the exhaust time to insure that a complete plunger cycle occurs. An analogous operation should be understood with regard to a gas lift completion as illustrated above in connection with FIG. 2.

While particular embodiments of the invention have been described, it is obvious that changes and modifications may be made therein and still remain within the scope and spirit of the invention. It is the intent that the appended claims cover all such changes and modifications.

What is claimed is:

1. A method for controlling the cyclic operation of a petroleum producing well having a motor valve connected between the tubing of the well and a flow sales line comprising:

reciprocating a plunger mounted for movement within the tubing of the well from the bottom thereof to the well head to carry production liquids from the well to the flow sales line in response to downhole casing pressure when the motor valve is open;

sensing when the plunger arrives at its uppermost position in the well tubing;

closing said motor valve in response to sensing plunger arrival;

storing in a selectively programmable memory signals indicative of a first time period during which the motor valve is to be closed and the well is to be shut-in and a second time period during which the motor valve is to be open and the fluid in the tubing allowed to flow into the sales line;

closing the motor valve and beginning the first time period;

opening the motor valve in response to expiration of the first time period and beginning the second time period;

closing the motor valve and beginning the first time period in response to sensing plunger arrival;

decreasing the first time period by a first selected incremental time value in response to the arrival of the plunger prior to expiration of the second time period;

closing the motor valve and beginning the first time period in response to expiration of the second time period; and increasing the first time period by a second selected incremental time value in response to the failure of the plunger to arrive prior to the expiration of the second time period.

2. A method for controlling the cyclic operation of a petroleum producing well having a motor valve connected between the tubing of the well and a flow sales line as set forth in claim 1 which includes the additional step of:

increasing the first time period by a third selected incremental value greater than said second incremental value in response to failure of the plunger to arrive prior to the expiration of said second time period on two successive occurrences.

3. A method for controlling the cyclic operation of a petroleum producing well having a motor valve connected between the tubing of the well and a flow sales line comprising:

reciprocating a plunger mounted for movement within the tubing of the well from the bottom thereof to the well head to carry liquids from the well to the flow sales line in response to downhole casing pressure when the motor valve is open and thereafter allow production gas to flow into the sales line;

sensing when the plunger arrives at its uppermost position in the well tubing;

closing said motor valve in response to sensing plunger arrival;

storing in a selectively programmable memory signals indicative of a first time period during which the motor valve is to be closed and the well is to be shut-in, a second time period following opening of the motor valve during which the plunger is to reach its uppermost position in the tubing and a third time period during which the first motor valve is to be open and production gas allowed to flow into the sales line;

closing the motor valve and beginning the first time period;

opening the motor valve in response to expiration of the first time period and beginning the second and third time periods;

closing the motor valve and beginning the first time period in response to the first to occur of either the expiration of the second time period prior to the plunger arrival or the expiration of the third time period;

increasing the third time period by a first selected incremental time value in response to the plunger arrival prior to the expiration of the second time period; and decreasing the third time period by a second selected incremental value in response to failure of the plunger to arrive prior to the expiration of the second time period.

4. A method for controlling the cyclic operation of a petroleum producing well having a motor valve connected between the tubing of the well and a flow sales line as set forth in claim 3, which includes the additional step of:

decreasing the third time period by a third selected incremental value greater than said second incremental value in response to failure of the plunger to arrive prior to the expiration of said second time period on two successive cycles.

5. A method for controlling the cyclic operation of a petroleum producing well having a motor valve connected between the tubing of the well and a flow sales line as set forth in claim 3 wherein said second time period is equal to said third time period.

6. A method for controlling the operation of a plunger completion petroleum production well having a motor valve connected between the tubing of the well and a flow sales line comprising:

detecting the arrival of the plunger at the wellhead;

storing in a selectively programmable memory signal indicative of a first time period during which the well is to be shut-in by closing the motor valve and a second time period during which the well is to be allowed to flow by opening the motor valve;

closing the motor valve and beginning the first time period;

opening the motor valve in response to expiration of the first time period and beginning the second time period;

closing the motor valve in response to detection of the plunger reaching the wellhead;

decreasing the length of the first time period for the next cycle of the well in response to the plunger having reached the wellhead before the expiration of the second time period; and increasing the length of the first time period in response to the plunger not reaching the wellhead before the expiration of the second time period.

7. A method for controlling the cyclic operation of a petroleum production well as set forth in claim 6 wherein the length of the first time period is decreased by a pre-selected value on the order of 5% of the value of the first time period.

8. A method for controlling the cyclic operation of a petroleum production well as set forth in claim 6 wherein the first time period is increased by a pre-selected value in response to the plunger not reaching the surface before the expiration of the second time period on a first occasion and increased by a value greater than said pre-selected value in response to the plunger not reaching the surface during the second time period on two successive occasions.

9. A method for controlling the cyclic operation of a plunger completion gas production well having a first motor valve connected between the tubing of the well and a flow sales line comprising:

detecting the arrival of the plunger at the wellhead;

storing in a selectively programmable memory signals indicative of a first time period during which the well is to shut-in, a second time period during which fluids are to be cleared from the well and a third time period during which gas is to be allowed to flow from the well after the fluids are cleared from the well;

closing said motor valve and beginning said first time period;

opening said motor valve in response to the expiration of said first time period;

beginning said second time period upon opening of said motor valve;

beginning said third time period in response to the plunger reaching the wellhead;

closing the motor valve and beginning the first time period in response to the first to occur of either the expiration of the second time period prior to the plunger reaching the wellhead or the expiration of the third time period;

increasing the value of the third time period in response to the plunger reaching the wellhead prior to expiration of the second time period;

decreasing the value of the third time period in response to the plunger not reaching the wellhead prior to expiration of the second time period.

10. A system for controlling the cyclic operation of a gas producing well having a first motor valve connected between the tubing and a fluid reservoir and a second motor valve connected between the tubing and a gas sales line, comprising:

selectively programmable memory means;

means for storing in said memory means signals indicative of a first time period during which fluids are to be cleared from the well, a second time period within which gas flow is to be allowed from the well after the fluids are cleared from the well and a third time period during which the well is to be shut in;

means responsive to the beginning of a cycle for opening the first motor valve and beginning the first time period;

means responsive to the expiration of the first time period for simultaneously opening said second motor valve and closing said first motor valve and beginning the second time period;

means responsive to the expiration of the second time period for closing the second motor valve and beginning the third time period;

means responsive to the expiration of the third time period for reopening the first motor valve and beginning the first time period;

means responsive to the arrival of a plunger at the upper most position in the tubing prior to the expiration of the first time period for simultaneously opening the second motor valve and closing the first motor valve and beginning the second time period;

means responsive to the arrival of a plunger at the uppermost position in the tubing prior to the expiration of the first time period for decreasing the length of the third time period on the next subsequent cycle; and means responsive to the failure of the plunger to arrive at the uppermost position in the tubing prior to the expiration of the first time period for increasing the length of the third time period during the next subsequent cycle.

11. A system for controlling the cyclic operation of a plunger lift completion gas producing well as set forth in claim 10 wherein the means for storing includes:

a key-board connected to said memory means and an optical display for selectively programming said memory with said time period values.

12. A system for controlling the cyclic operation of a plunger lift gas producing well having a first motor valve connected between the tubing and a fluid reservoir and a second motor valve connected between the tubing and a gas sales line, comprising:

selectively programmable memory means;

means for storing in said memory means signals indicative of a first time period during which fluids are to be cleared from the well, a second time period within which gas flow is to be allowed from the well after the fluids are cleared from the well and a third time period during which the well is to be shut in;

means responsive to the beginning of a cycle for opening the first motor valve and beginning the first time period;

means responsive to the expiration of the first time period for simultaneously opening said second motor valve and closing said first motor valve and beginning the second time period;

means responsive to the expiration of the second time period for closing the second motor valve and beginning the third time period;

means responsive to the expiration of the third time period for reopening the first motor valve and beginning the first time period;

means responsive to the arrival of a plunger at the upper most position in the tubing prior to the expiration of the first time period for simultaneously opening the second motor valve and closing the first motor valve and beginning the second time period;

means responsive to the arrival of a plunger at the uppermost position in the tubing prior to the expiration of the first time period for decreasing the length of the third time period on the next subsequent cycle;

means responsive to the failure of the plunger to arrive at the uppermost position in the tubing prior to the expiration of the first time period for increasing the length of the third time period during the next subsequent cycle; and wherein each of the said means for opening and closing motor valves include:

processing means;

peripheral interface adapter means;

a pair of solenoids connected to operate each motor valve;

a solenoid decoder connected between said peripheral interface adapter means and said solenoid; and data bus means interconnecting said processing means with the memory means and said peripheral interface adapter means to allow data flow therebetween and enable said processing means to control the solenoids based upon time period information stored in the memory means.

13. A system for controlling the cyclic operation of a plunger lift completion gas producing well as set forth in claim 11 wherein the system is battery powered and which also includes:

power save gating circuitry to power down all analog circuits and all digital functions other than timing and memory to conserve power;

a real time clock; and means responsive to regular periodic signals from the real time clock or a signal from the key-board for disabling the power save circuitry and supplying full operating power to the system.

14. A method for optimizing the production from a petroleum producing well having a motor valve connected between the tubing of the well and a flow sales line and a plunger mounted for movement within the tubing of the well from the bottom thereof to the well head to carry liquids from the well to the flow sales line in response to downhole casing pressure when the motor valve is open, the method comprising:

selecting a value of off-time for the well during which the motor valve is closed and the well is shut-in;

selecting a value of on-time for the well during which the motor valve is open;

opening the motor valve and beginning the selected on-time;

detecting the arrival of the plunger at the well head prior to the expiration of the on-time;

closing the motor valve, decreasing the value of off-time by a pre-selected incremental value, and beginning the off-time in response to detecting the arrival of the plunger at the well head prior to the expiration of the on-time; and closing the motor valve, increasing the value of off-time by a pre-selected incremental value and beginning the off-time in response to failure to detect the arrival of the plunger at the well head prior to the expiration of the on-time.

15. A method for optimizing the production from a petroleum producing well as set forth in claim 14 which also includes:

closing the motor valve, increasing the value of off-time by a second pre-selected value and beginning the off-time in response to a failure to detect the arrival of the plunger at the well head prior to the expiration of the on-time on two successive cycles, wherein the second pre-selected value is greater than the pre-selected value by which the off-time was increased in response to the first failure to detect plunger arrival.

16. A method for optimizing the production from a petroleum producing well having a motor valve connected between the tubing of the well and a flow sales line and a plunger mounted for movement within the tubing of the well from the bottom thereof to the well head to carry liquids from the well to the flow sales line in response to downhole casing pressure when the motor valve is open, the method comprising:

intermitting the opening and closing of the motor valve in accordance with an off-time period, during which said motor valve is closed to prevent flow from the well tubing to the flow sales line, an on-time period, during which said motor valve is open to allow flow from the well tubing to the flow sales line and a plunger arrival signal produced in response to the plunger reaching the well head;

decreasing the off-time by a pre-selected incremental value each time a plunger arrival signal is produced prior to the expiration of the on-time; and increasing the off-time by a pre-selected incremental value each time the on-time expires prior to production of a plunger arrival signal.

17. A method for optimizing the production from a petroleum producing well having a motor valve connected between the tubing of the well and a flow sales line and a plunger mounted for movement within the tubing of the well from the bottom thereof to the well head to carry liquids from the well to the flow sales line in response to downhole casing pressure when the motor valve is open, the method comprising:

intermitting the opening and closing of the motor valve in accordance with an off-time period, during which said motor valve is closed to prevent flow from the well tubing to the flow sales line, an on-time period, during which said motor valve is open to allow flow from the well tubing to the flow sales line and a plunger arrival signal produced in response to the plunger reaching the well head;

decreasing the off-time by a preselected incremental value each time a plunger arrival signal is produced prior to the expiration of the on-time; and increasing the off-time by a pre-selected incremental value each time the on-time expires prior to production of a plunger arrival signal and increasing it by a second pre-selected value greater than said pre-selected value in response to expiration of the on-time prior to production of a plunger arrival signal on two successive cycles of intermitting.

18. A method for optimizing the production from a gas producing well having a motor valve connected between the tubing of the well and a flow sales line and a plunger mounted for movement within the tubing of the well from the bottom thereof to the well head to carry liquids from within the well in response to downhole casing pressure when the motor valve is open, the method comprising:

selecting a value of off-time for the well during which the motor valve is closed and the well is shut-in;

selecting a value of on-time for the well during which the motor valve is open and the well is to be cleared of fluids;

selecting a value of exhaust-time for the well during which the motor valve is open and production gas is to be delivered from the well to the flow sales line;

opening the motor valve and beginning the selected on-time;

detecting the arrival of the plunger at the well head prior to the expiration of the on-time and beginning the exhaust time in response thereof;

closing the motor valve, increasing the value of exhaust-time by a pre-selected incremental value, and beginning the off-time in response to expiration of the exhaust time following detecting the arrival of the plunger at the well head prior to the expiration of the on-time; and closing the motor valve, decreasing the value of exhaust time by a pre-selected incremental value and beginning the off-time in response to a failure to detect the arrival of the plunger at the wellhead prior to the expiration of the on-time.

19. A method for optimizing the production from a petroleum producing well as wet forth in claim 18 which also includes:

closing the motor valve, decreasing the value of exhaust time by a second pre-selected value and beginning the off-time in response to a failure to detect the arrival of the plunger at the well head prior to the expiration of the on-time on two successive cycles, wherein the second pre-selected value is greater than the pre-selected value by which the exhaust-time was decreased in response to the first failure to detect plunger arrival.

20. A method for optimizing the production from a gas producing well having a motor valve connected between the tubing of the well and a flow sales line and a plunger mounted for movement within the tubing of the well from the bottom thereof to the well head to carry liquids from the well in response to downhole casing pressure when the motor valve is open, the method comprising:

intermitting the opening and closing of the motor valve in accordance with an off-time period, during which said motor valve is closed to prevent flow from the well tubing to the flow sales line, and on-time period, during which said motor valve is open to allow flow from the well tubing to the flow sales line, an exhaust-time period, during which said motor valve is allowed to remain open to allow flow from the well tubing to the flow sales line after the on-time period has expired and a plunger arrival signal produced in response to the plunger reaching the well head;

increasing the exhaust-time by a pre-selected incremental value each time a plunger arrival signal is produced prior to the expiration of the on-time; and decreasing the exhaust-time by a pre-selected incremental value each time the on-time expires prior to production of a plunger arrival signal.

21. A method for optimizing the production from a gas producing well having a motor valve connected between the tubing of the well and a flow sales line and a plunger mounted for movement within the tubing of the well from the bottom thereof to the well head to carry liquids from the well in response to downhole casing pressure when the motor valve is open, the method comprising:

intermitting the opening and closing of the motor valve in accordance with an off-time period, during which said motor valve si closed to prevent flow from the well tubing to the flow sales line, and on-time period, during which said motor valve is open to allow flow from the well tubing to the flow sales line, an exhaust-time period, during which said motor valve is allowed to remain open to allow flow from the well tubing to the flow sales line after the on-time period has expired and a plunger arrival signal produced in response to the plunger reaching the well head;

increasing the exhaust-time by a pre-selected incremental value each time a plunger arrival signal is produced prior to the expiration of the on-time;

decreasing the exhaust-time by a pre-selected incremental value each time the on-time expires prior to production of a plunger arrival signal and decreasing it by a second pre-selected value greater than said pre-selected value in response to expiration of the on-time prior to production of a plunger arrival signal on two successive cycles of intermitting.

22. A system for controlling the cyclic operation of a petroleum producing well having a motor valve connected between the tubing of the well and a flow sales line comprising:

a plunger mounted for reciprocating movement within the tubing of the well from the bottom thereof to the well head to carry production liquids from the well to the flow sales line in response to downhole casing pressure when the motor valve is open;

means for sensing when the plunger arrival at its uppermost position in the well tubing;

means for closing said motor valve in response to sensing plunger arrival;

means for storing in a selectively programmable memory signals indicative of a first time period during which the motor valve is to be closed and the well is to be shut-in and a second time period during which the motor valve is to be open and the fluid in the tubing allowed to flow into the sales line;

means for closing the motor valve and beginning the first time period;

means for opening the motor valve in response to expiration of the first time period and beginning the second time period;

means for closing the motor valve and beginning the first time period in response to the sensing of plunger arrival;

means for decreasing the first time period by a first selected incremental time value in response to the arrival of the plunger prior to expiration of the second time period;

means for closing the motor valve and beginning the first time period in response to expiration of the second time period; and means for increasing the first time period by a second selected incremental time value in response to the failure of the plunger to arrive prior to the expiration of the second time period.

23. A system for controlling the cyclic operation of a petroleum producing well having a motor valve connected between the tubing of the well and a flow sales line as set forth in claim 22 which also includes:

means for increasing the first time period by a third selected incremental value greater than said second incremental value in response to failure of the plunger to arrive prior to the expiration of said second time period on two successive occurrences.

24. A system for controlling the cyclic operation of a petroleum producing well having a motor valve connected between the tubing of the well and a flow sales line comprising:

a plunger mounted for reciprocating movement within the tubing of the well from the bottom thereof to the well head to carry liquids from the well to the flow sales line in response to downhole casing pressure when the motor valve is open and thereafter allow production gas to flow into the sales line;

means for sensing when the plunger arrives at its uppermost position in the well tubing;

means for closing said motor valve in response to sensing plunger arrival;

means for storing in a selectively programmable memory signals indicative of a first time period during which the motor valve is to be closed and the well is to be shut-in, a second time period following opening of the motor valve during which the plunger is to reach its uppermost position in the tubing and a third time period during which the first motor valve is to be open and production gas allowed to flow into the sales line;

means for closing the motor valve and beginning the first time period;

opening the motor valve in response to expiration of the first time period and beginning the second and third time periods;

means for closing the motor valve and beginning the first time period in response to the first to occur of either the expiration of the second time period prior to the plunger arrival or the expiration of the third time period;

means for increasing the third time period by a first selected incremental time value in response to the plunger arrival prior to the expiration of the second time period; and means for decreasing the third time period by a second selected incremental value in response to failure of the plunger to arrive prior to the expiration of the second time period.

25. A system for controlling the cyclic operation of a petroleum producing well having a motor valve connected between the tubing of the well and a flow sales line as set forth in claim 24, which also includes:

means for decreasing the third time period by a third selected incremental value greater than said second incremental value in response to failure of the plunger to arrive prior to the expiration of said second time period on two successive cycles.

26. A system for controlling the operation of a petroleum producing well having a motor valve connected between the tubing of the well and a flow sales line as set forth in claim 24 wherein said second time period is equal to said third time period.

27. A system for controlling the cyclic operation of a plunger completion petroleum production well having a motor valve connected between the tubing of the well and a flow sales line comprising:

means for detecting the arrival of the plunger at the wellhead;

means for storing in a selectively programmable memory signals indicative of a first time period during which the well is to be shut-in by closing the motor valve and a second time period during which the well is to be allowed to flow by opening the motor valve;

means for closing the first motor valve and beginning the first time period;

means for opening the motor valve in response to expiration of the first time period and beginning the second time period;

means for closing the first motor valve in response to detection of the plunger reaching the wellhead;

means for decreasing the length of the first time period for the next cycle of the well in response to the plunger having period; and means for increasing the length of the first time period in response to the plunger not reaching the wellhead before the expiration of the second time period.

28. A system for controlling the cyclic operation of a petroleum production well as set forth in claim 27 wherein the length of the first time period is decreased by a pre-selected value on the order of 5% of the value of the first time period.

29. A system for controlling the cyclic operation of a petroleum production well as set forth in claim 27 wherein the first time period is increased by a pre-selected value in response to the plunger not reaching the surface before the expiration of the second time period on a first occasion and increased by a value greater than said pre-selected value in response to the plunger not reaching the surface during the second time period on two successive cycles.

30. A system for controlling the cyclic operation of a plunger completion gas production well having a first motor valve connected between tubing of the well and a flow sales line comprising:

means for detecting the arrival of the plunger at the wellhead;

means for storing in a selectively programmable memory signals indicative of a first time period during which the well is to be shut-in, a second time period during which fluids are to be cleared from the well and a third time period during which gas is to be allowed to flow from the well after the fluids are cleared from the well;

means for closing said motor valve and beginning said first time period;

means for opening said motor valve in response to the expiration of said first time period;

means for beginning said second time period upon opening of said motor valve;

means for beginning said third time period in response to the plunger reaching the wellhead;

means for closing the motor valve and beginning the first time period in response to the first to occur of either the expiration of the second time period prior to the plunger reaching the wellhead or the expiration of the third time period;

means for increasing the value of the third time period in response to the plunger reaching the wellhead prior to expiration of the second time period; and means for decreasing the value of the third time period in response to the plunger not reaching the wellhead prior to expiration of the second time period.

31. A system for optimizing the production from a petroleum producing well having a motor valve connected between the tubing of the well and a flow sales line and a plunger mounted for movement within the tubing of the well from the bottom thereof to the well head to carry liquids from the well to the flow sales line in response to downhole casing pressure when the motor valve is open, the method comprising:

means for selecting a value of off-time for the well during which the motor valve is closed and the well is shut-in;

means for selecting a value of on-time for the well during which the motor valve is open;

means for opening the motor valve and beginning the selected on-time;

means for detecting the arrival of the plunger at the well head prior to the expiration of the on-time;

means for closing the motor valve, decreasing the value of off-time by a pre-selected incremental value, and beginning the off-time in response to detecting the arrival of the plunger at the well head prior to the expiration of the on-time; and means for closing the motor valve, increasing the value of off-time by a pre-selected incremental value and beginning the off-time in response to failure to detect the arrival of the plunger at the well head prior to the expiration of the on-time.

32. A system for optimizing the production from a petroleum producing well as set forth in claim 31 which also includes:

means for closing the motor valve, increasing the value of off-time by a second pre-selected value and beginning the off-time in response to a failure to detect the arrival of the plunger at the well head prior to the expiration of the on-time on two successive cycles, wherein the second pre-selected value is greater than the pre-selected value by which the off-time was increased in response to the first failure to detect plunger arrival.

33. A system for optimizing the production from a petroleum producing well having a motor valve connected between the tubing of the well and a flow sales line and a plunger mounted for movement within the tubing of the well from the bottom thereof to the well head to carry liquids from the well to the flow sales line in response to downhole casing pressure when the motor valve is open, the method comprising:

means for intermitting the opening and closing of the motor valve in accordance with an off-time period, during which said motor valve is closed to prevent flow from the well tubing to the flow sales lines, an on-time period, during which said motor valve is open to allow flow from the well tubing to the flow sales line and a plunger arrival signal produced in response to the plunger reaching the well head;

means for decreasing the off-time by a pre-selected incremental value each time a plunger arrival signal is produced prior to the expiration of the on-time; and means for increasing the off-time by a pre-selected incremental value each time the on-time expires prior to production of a plunger arrival signal.

34. A system for optimizing the production from a petroleum producing well having a motor valve connected between the tubing of the well and a flow sales line and a plunger mounted for movement within the tubing of the well from the bottom thereof to the well head to carry liquids from the well to the flow sales line in response to douwnhole casing pressure when the motor valve is open, the method comprising:

means for intermitting the opening and closing of the motor valve in accordance with an off-time period, during which said motor valve is closed to prevent flow from the well tubing to the flow sales lines, an on-time period, during which said motor valve is open to allow flow from the well tubing to the flow sales line and a plunger arrival signal produced in response to the plunger reaching the well head;

means for decreasing the off-time by a pre-selected incremental value each time a plunger arrival signal is produced prior to the expiration of the on-time;

means for increasing the off-time by a pre-selected incremental value each time the on-time expires prior to production of a plunger arrival signal and increasing it by a second pre-selected value greater than said pre-selected value in response to expiration of the on-time prior to production of a plunger arrival signal on two successive cycles of intermitting.

35. A method for optimizing the production from a petroleum producing well having a motor valve connected between the tubing of the well and a flow sales lines and a plunger mounted for movement within the tubing of the well from the bottom thereof to the wellhead to carry liquids from the well to the flow sales line in response to downhole casing pressure when the motor valve is open, the method comprising:

selecting a value of off-time for the well during which the motor valve is closed and the well is shut-in;

selecting a value of on-time for the well during which the motor valve is open and fluids pass from the well;

selecting a value of exhaust-time for the well during which the motor valve is open and the tubing is connected to the flow sales line;

detecting the arrival of the plunger at the wellhead;

cyclically intermitting the opening and closing of the motor valve in accordance with the sequential expiration of off-time, on-time and exhaust-time;

changing the value of either the off-time or the exhaust-time in response to whether a plunger arrival is detected prior to the expiration of the on-time on each successive cycle of intermitting of the well.

36. A method for optimizing the production from a petroleum production well as set forth in claim 35 wherein:

the value of the off-time is decreased in response to detection of a plunger arrival signal prior to the expiration of the on-time.

37. A method for optimizing the production from a petroleum production well as set forth in claim 36 wherein:

the value of the off-time is increased in response to a failure to detect a plunger arrival signal prior to the expiration of the on-time.

38. A method for optimizing the production from a petroleum production well as set forth in claim 36 wherein:

the value of the exhaust-time is increased in response to detection of a plunger arrival signal prior to the expiration of the on-time.

39. A method for optimizing the production from a petroleum production well as set forth in claim 36 wherein:

the value of the exhaust-time is decreased in response to failure to detect a plunger arrival signal prior to the expiration of the on-time.

* * * * *